US008276531B2

(12) United States Patent
Tashiro

(10) Patent No.: US 8,276,531 B2
(45) Date of Patent: Oct. 2, 2012

(54) EMBROIDERY DATA PROVIDING APPARATUS, COMPUTER-READABLE MEDIUM STORING EMBROIDERY DATA PROVIDING PROGRAM, AND EMBROIDERY DATA PROVIDING SYSTEM

(75) Inventor: Noriharu Tashiro, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 537 days.

(21) Appl. No.: 12/591,740

(22) Filed: Nov. 30, 2009

(65) Prior Publication Data

US 2010/0139538 A1 Jun. 10, 2010

(30) Foreign Application Priority Data

Dec. 10, 2008 (JP) ..... 2008-314598

(51) Int. Cl.
*D05B 19/08* (2006.01)
*D05C 5/02* (2006.01)

(52) U.S. Cl. ..... 112/102.5; 700/138

(58) Field of Classification Search ..... 112/470.01–470.04, 102.5, 103, 112/470.18, 475.05, 470.09; 700/136–138
See application file for complete search history.

(56) References Cited

U.S. PATENT DOCUMENTS 4,823,714 A 4/1989 Yokoe et al.
5,072,680 A * 12/1991 Nakashima ..... 112/445
5,255,620 A * 10/1993 Sasano et al. ..... 112/102.5
5,390,615 A * 2/1995 Sugimoto ..... 112/102.5
5,791,270 A 8/1998 Mori
5,960,727 A 10/1999 Miyasako et al.
5,970,894 A * 10/1999 Mase ..... 112/102.5
6,196,146 B1 3/2001 Goldberg et al.
6,256,551 B1 7/2001 Muto
6,813,535 B2 11/2004 Akira et al.
6,889,111 B2 5/2005 Tomita
7,313,457 B2 * 12/2007 Yoshimura et al. ..... 700/138

FOREIGN PATENT DOCUMENTS

JP A-57-61755 4/1982
JP A-63-267387 11/1988
JP A-4-24049 1/1992

(Continued)

OTHER PUBLICATIONS

Japanese Office Action mailed Apr. 12, 2011 issued in Japanese Patent Application No. 2008-314598 (with translation).

(Continued)

*Primary Examiner* — Ismael Izaguirre
(74) *Attorney, Agent, or Firm* — Oliff & Berridge, PLC

(57) ABSTRACT

An embroidery data providing apparatus includes a model information acquisition device that acquires model information, a size storage device that stores the model information and at least one embroiderable size in association with one another, a size acquisition device that acquires the at least one embroiderable size that corresponds to the acquired model information, a pattern information acquisition device that acquires target pattern information relating to a target pattern, an embroidery data output device that outputs as output data at least one of embroidery data of the target pattern and data for generating the embroidery data, a size determination device that determines whether the target pattern will fit within the acquired at least one embroiderable size, and a restriction device that, in a case where it is determined that the target pattern will not fit, restricts at least one of outputting of the output data and pre-output processing.

16 Claims, 17 Drawing Sheets

FOREIGN PATENT DOCUMENTS

| | | |
|---|---|---|
| JP | A-7-16366 | 1/1995 |
| JP | A-7-24160 | 1/1995 |
| JP | A-9-168680 | 6/1997 |
| JP | A-9-188955 | 7/1997 |
| JP | A-10-118365 | 5/1998 |
| JP | A-10-328450 | 12/1998 |
| JP | A-11-57260 | 3/1999 |
| JP | A-11-104373 | 4/1999 |
| JP | A 11-104376 | 4/1999 |
| JP | A-11-124762 | 5/1999 |
| JP | A-11-128574 | 5/1999 |
| JP | A-2000-24350 | 1/2000 |
| JP | A-2000-197781 | 7/2000 |
| JP | A 2001-314677 | 11/2001 |
| JP | A 2002-191878 | 7/2002 |
| JP | A 2002-203156 | 7/2002 |
| JP | A 2002-292165 | 10/2002 |
| JP | A 2002-292166 | 10/2002 |
| JP | A 2002-297927 | 10/2002 |
| JP | A 2004-141471 | 5/2004 |
| JP | A 2004-329580 | 11/2004 |

OTHER PUBLICATIONS

Japanese Office Action mailed Sep. 28, 2010 issued in Japanese Patent Application No. 2008-314598 (with translation).

* cited by examiner

FIG. 4

552

200

| USER INFORMATION DATABASE | | | | |
|---|---|---|---|---|
| USER NAME | E-MAIL ADDRESS | PASSWORD | PRODUCT NUMBER | ··· |
| ABCD | xxx@xxx.xx | ******** | 01234567890123 | ··· |
| EFGH | yyy@yyy.yy | ******** | 09876543219876 | ··· |
| | | | | |

FIG. 6

553

300

| MACHINE INFORMATION DATABASE | | | |
|---|---|---|---|
| PRODUCT NUMBER | MODEL | EMBROIDERABLE FRAME SIZE | ··· |
| 01234567890123 | A model | 10x10, 13x18, 20x30, 50x10 | ··· |
| 09876543219876 | B model | 10x10, 13x18 | ··· |
| | | | |

EMBROIDERY DATA PROVIDING APPARATUS, COMPUTER-READABLE MEDIUM STORING EMBROIDERY DATA PROVIDING PROGRAM, AND EMBROIDERY DATA PROVIDING SYSTEM

CROSS-REFERENCE TO RELATED APPLICATION

This application claims priority to Japanese Patent Application No. 2008-314598, filed Dec. 10, 2008, the disclosure of which is incorporated herein by reference in its entirety.

BACKGROUND

The present invention relates to an embroidery data providing apparatus, a computer-readable medium that stores an embroidery data providing program, and an embroidery data providing system that provide embroidery data that are used by a sewing machine that is capable of embroidering various types of patterns.

An embroidery data providing system is known that provides embroidery data from a server to a terminal device through a network. The embroidery data that have been provided from the server are stored in a memory. A sewing machine performs embroidery sewing on a work cloth based on embroidery data that are read from the memory.

In this sort of embroidery data providing system, an embroidery pattern that is built into the sewing machine and an embroidery pattern that is not built into the sewing machine, for example, are identifiably displayed on a display of the terminal device. By operating the terminal device, a user can download from the server to the sewing machine the embroidery pattern that is not built into the sewing machine.

SUMMARY

In the embroidery data providing system in the example that is described above, it sometimes happens that the size of the embroidery pattern that is indicated by the embroidery data that are downloaded from the server is larger than an embroidery frame that can be used on the sewing machine. In some cases where that occurs, the user is obliged to recreate the embroidery data to fit the size of the embroidery frame that can be used on the sewing machine.

Various exemplary embodiments of the general principles herein provide an embroidery data providing apparatus, a computer-readable medium that stores an embroidery data providing program, and an embroidery data providing system that are capable of providing embroidery data for performing excellent embroidery sewing on a sewing machine.

The exemplary embodiments provide an embroidery data providing apparatus that includes a model information acquisition device, a size storage device, a size acquisition device, a pattern information acquisition device, an embroidery data output device, a size determination device, and a restriction device. The model information acquisition device that acquires, from an identification information storage device storing identification information and model information in association with one another, the model information that corresponds to the identification information input by an input device for inputting information, or acquires the model information input by the input device, the identification information being unique to a user or to a sewing machine, and the model information indicating a model of the sewing machine. The size storage device that stores the model information and at least one embroiderable size in association with one another, the at least one embroiderable size indicating a size of an embroidery pattern that can be sewn by the model of the sewing machine indicated by the model information. The size acquisition device that, from the size storage device, acquires the at least one embroiderable size that corresponds to the model information acquired by the model information acquisition device. The pattern information acquisition device that acquires target pattern information, the target pattern information being information relating to a target pattern, the target pattern being an embroidery pattern to be embroidered by the model of the sewing machine indicated by the model information acquired by the model information acquisition device. The embroidery data output device that outputs as output data, to a storage device that is capable of storing information, at least one of embroidery data of the target pattern to be used by the model of the sewing machine indicated by the model information and data for generating the embroidery data of the target pattern. The size determination device that, based on the target pattern information acquired by the pattern information acquisition device, determines whether the target pattern will fit within the at least one embroiderable size acquired by the size acquisition device. The restriction device that, in a case where it is determined by the size determination device that the target pattern will not fit within the at least one embroiderable size, restricts at least one of outputting of the output data by the embroidery data output device and pre-output processing relating to the embroidery data of the target pattern.

The exemplary embodiments also provide a computer-readable medium that stores an embroidery data providing program. The embroidery data providing program includes instructions that cause a computer to perform a step of acquiring, from an identification information storage device storing identification information and model information in association with one another, the model information that corresponds to the identification information input by an input device for inputting information, or the model information input by the input device, the identification information being unique to a user or to a sewing machine, and the model information indicating a model of the sewing machine. The embroidery data providing program also includes instructions for a step of acquiring, from a size storage device that stores the model information and at least one embroiderable size in association with one another, the at least one embroiderable size that corresponds to the model information that has been acquired, the at least one embroiderable size indicating a size of an embroidery pattern that can be sewn by the model of the sewing machine indicated by the model information. The embroidery data providing program also includes instructions for a step of acquiring target pattern information, the target pattern information being information relating to a target pattern, the target pattern being an embroidery pattern to be embroidered by the model of the sewing machine indicated by the model information that has been acquired. The embroidery data providing program also includes instructions for a step of outputting as output data, to a storage device that is capable of storing information, at least one of embroidery data of the target pattern to be used by the model of the sewing machine indicated by the model information and data for generating the embroidery data of the target pattern. The embroidery data providing program also includes instructions for a step of determining, based on the target pattern information that has been acquired, whether the target pattern will fit within the at least one embroiderable size that has been acquired. The embroidery data providing program also includes instructions for a step of restricting, in a case where it is determined that the target pattern will not fit within the at least one embroiderable size, at least one of outputting of the output data and pre-output processing relating to the embroidery data of the target pattern.

The exemplary embodiments also provide an embroidery data providing system in which a terminal apparatus and a server are connected to one another through a network. The terminal apparatus includes an information transmission device, a screen display device, a target pattern transmission device, and an embroidery data storage device. The information transmission device that transmits, to the server, at least one of identification information and model information that have been input to the terminal apparatus, the identification information being unique to a user or to a sewing machine, and the model information indicating a model of the sewing machine. The screen display device that displays an edit screen for at least one of creating and editing an embroidery pattern, based on information for generating the edit screen that has been received from the server. The a target pattern transmission device that transmits target pattern information to the server, the target pattern information being information relating to a target pattern, the target pattern being an embroidery pattern that has been at least one of created and edited on the edit screen. The embroidery data storage device that stores embroidery data of the target pattern that have been received from the server and will be used for embroidery sewing by the sewing machine. The server includes a model information acquisition device, a size storage device, a size acquisition device, a screen information transmission device, an embroidery data generation device, an embroidery data transmission device, a size determination device, and a restriction device. The model information acquisition device that acquires, from an identification information storage device storing the identification information and the model information in association with one another, the model information that corresponds to the identification information received from the terminal apparatus, or acquires the model information received from the terminal apparatus. The size storage device that stores the model information and at least one embroiderable size in association with one another, the at least one embroiderable size indicating a size of an embroidery pattern that can be sewn by the model of the sewing machine indicated by the model information. The size acquisition device that, from the size storage device, acquires the at least one embroiderable size that corresponds to the model information acquired by the model information acquisition device. The screen information transmission device that transmits, to the terminal apparatus, the information for generating the edit screen in a state in which the at least one embroiderable size that has been acquired by the size acquisition device is graphically shown. The embroidery data generation device that generates the embroidery data of the target pattern based on the target pattern information received from the terminal apparatus. The embroidery data transmission device that transmits, to the terminal apparatus, the embroidery data of the target pattern generated by the embroidery data generation device. The size determination device that, based on the target pattern information received from the terminal apparatus, determines whether the target pattern will fit within the at least one embroiderable size that has been acquired by the size acquisition device. The restriction device that, in a case where it is determined by the size determination device that the target pattern will not fit within the at least one embroiderable size, restricts at least one of generating of the embroidery data of the target pattern by the embroidery data generation device and transmitting of the embroidery data by the embroidery data transmission device.

The exemplary embodiments provide an embroidery data providing apparatus that includes a model information acquisition device, a range storage device, a range acquisition device, a pattern information acquisition device, an embroidery data output device, a range determination device, and a restriction device. The model information acquisition device that acquires, from an identification information storage device storing identification information and model information in association with one another, the model information that corresponds to the identification information input by an input device for inputting information, or acquires the model information input by the input device, the identification information being unique to a user or to a sewing machine, and the model information indicating a model of the sewing machine. The range storage device that stores the model information and a sewable range in association with one another, the sewable range being a range within which the model of the sewing machine indicated by the model information is capable of sewing. The range acquisition device that acquires, from the range storage device, the sewable range that corresponds to the model information acquired by the model information acquisition device. The pattern information acquisition device that acquires target pattern information, the target pattern information being information relating to a target pattern, the target pattern being an embroidery pattern to be embroidered by the model of the sewing machine indicated by the model information acquired by the model information acquisition device. The embroidery data output device that outputs as output data, to a storage device that is capable of storing information, at least one of embroidery data of the target pattern to be used by the model of the sewing machine indicated by the model information and data for generating the embroidery data of the target pattern. The range determination device that, based on the target pattern information acquired by the pattern information acquisition device, determines whether the target pattern will fit within the sewable range acquired by the range acquisition device. The restriction device that, in a case where it is determined by the range determination device that the target pattern will not fit within the sewable range, restricts at least one of outputting of the output data by the embroidery data output device and pre-output processing relating to the embroidery data of the target pattern.

BRIEF DESCRIPTION OF THE DRAWINGS

Exemplary embodiments will be described below in detail with reference to the accompanying drawings in which:

FIG. 4 is a data configuration diagram of a user information database that is stored in a user information storage area;

FIG. 6 is a data configuration diagram of a machine information database that is stored in a machine information storage area;

DETAILED DESCRIPTION

Hereinafter, a first embodiment of the present disclosure will be explained with reference to FIGS. 1 to 14.

Figure 1:
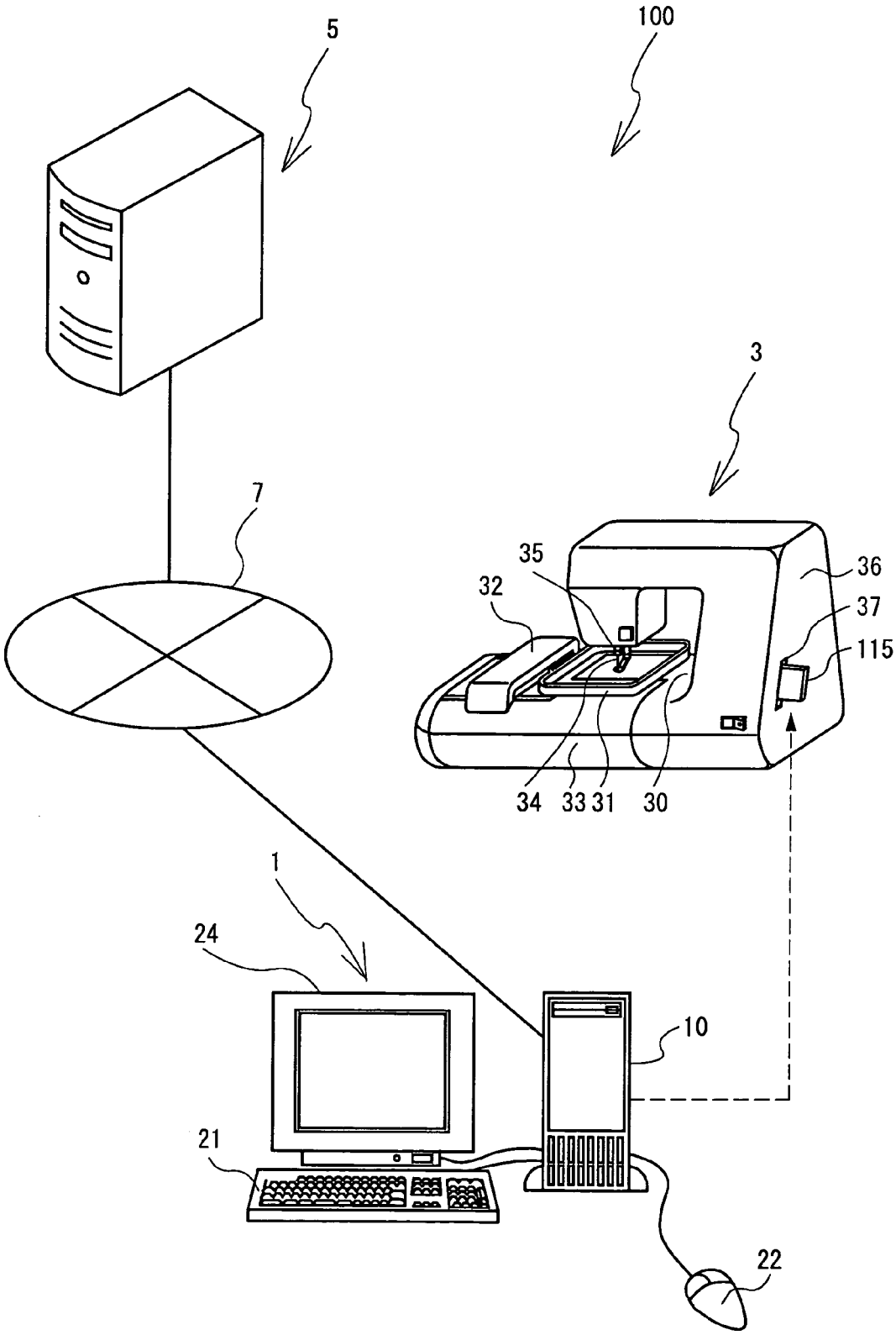
FIG. 1 is a system configuration diagram of an embroidery data providing system.

As shown in FIG. 1, an embroidery data providing system 100 according to the present embodiment includes a personal computer (PC) 1 that is a terminal device for a user and a server 5 that is managed by a provider of embroidery data. The PC 1 and the server 5 are connected through an Internet 7. The user operates the PC 1 and accesses the server 5 in order to perform editing of an embroidery pattern (which hereinafter also includes creating the embroidery pattern). The server 5 creates embroidery data for sewing the embroidery pattern that has been edited by the user. The user downloads to the PC 1 the embroidery data that have been created by the server 5. The user writes to a portable memory (for example, a memory card 115) the embroidery data that have been downloaded from the PC 1, then mounts the portable memory in a sewing machine 3 and causes the sewing machine 3 to read the embroidery data. In the sewing machine 3, embroidery sewing is performed on a work cloth based on the embroidery data that have been read from the portable memory. In this manner, the embroidery pattern that has been edited by the user is formed on the work cloth.

A configuration of the PC 1 will be explained with reference to FIGS. 1 and 2. As shown in FIG. 1, the PC 1 has the same sort of configuration as a known personal computer. A keyboard 21 and a mouse 22 that accept input operations by the user, as well as a display 24 on which still images, moving images, and the like are displayed, are connected to a device main body 10.

Figure 2:
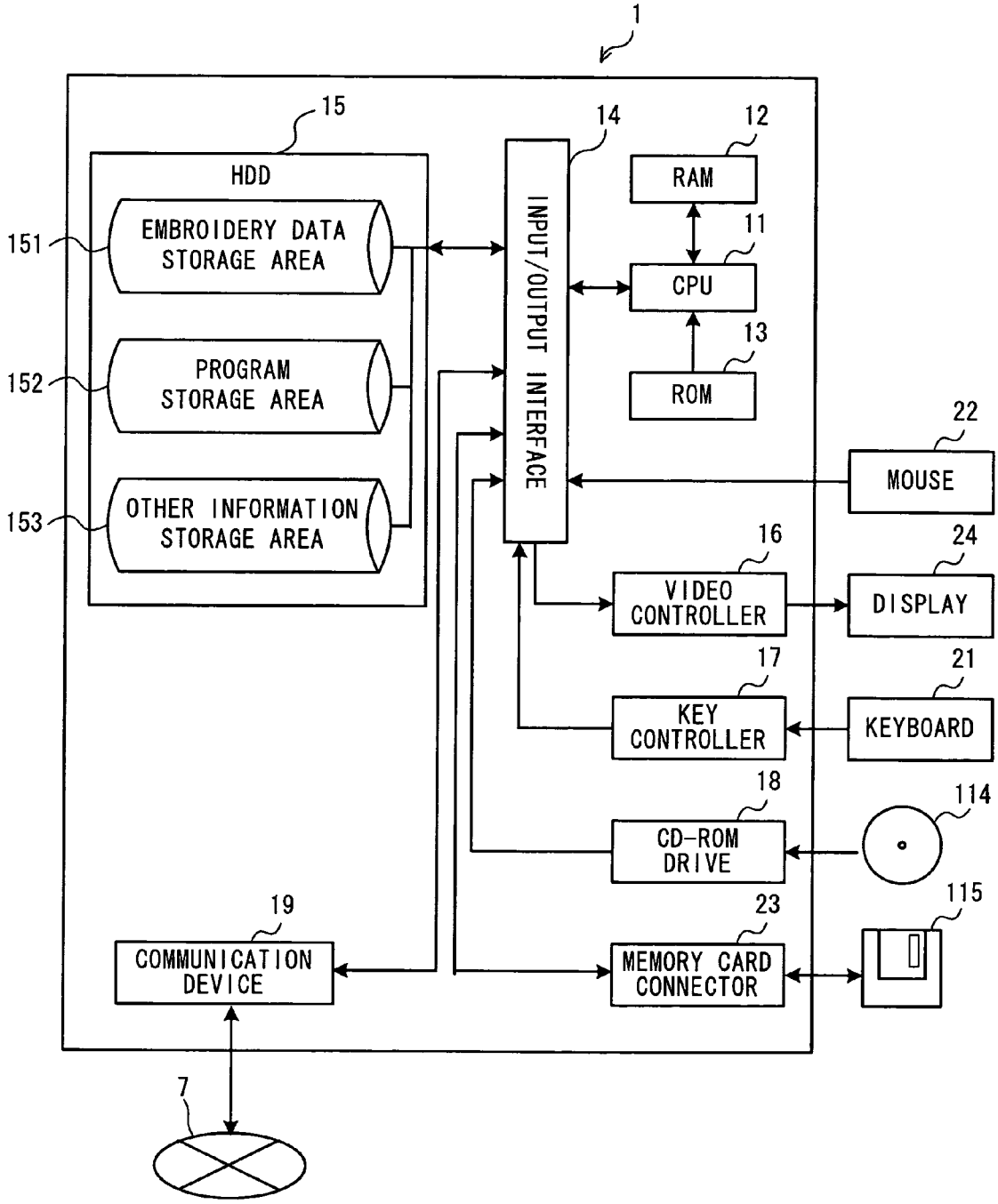
FIG. 2 is a block diagram that shows an electrical configuration of a personal computer (PC) according to a first embodiment.

As shown in FIG. 2, in the PC 1, a RAM 12, a ROM 13, and an input/output interface 14 are connected to a CPU 11 that performs control of the PC 1. The RAM 12 stores various types of data temporarily. The ROM 13 stores a BIOS and the like. The input/output interface 14 mediates exchanges of data. A hard disk drive (HDD) 15 is connected to the input/output interface 14. At least an embroidery data storage area 151, a program storage area 152, and an other information storage area 153 are provided in the HDD 15. The embroidery data that are downloaded from the server 5 are stored in the embroidery data storage area 151. At least browser software (hereinafter called the browser) for accessing the server 5 through the Internet 7 is stored in the program storage area 152. Other information that is used by the PC 1 is stored in the other information storage area 153.

The mouse 22, a video controller 16, a key controller 17, a communication device 19, a CD-ROM drive 18, and a memory card connector 23 are connected to the input/output interface 14. The video controller 16 performs display control of the still images, the moving images, and the like on the display 24, which is connected to the video controller 16. The key controller 17 performs control of the accepting of key inputs by the keyboard 21, which is connected to the key controller 17. The communication device 19 performs control of communication with another computer (the server 5 in the present embodiment) through the Internet 7. The CD-ROM drive 18 performs reading of a CD-ROM 114 that is inserted into the CD-ROM drive 18. The memory card connector 23 performs reading and writing on the memory card 115, which is mounted in the memory card connector 23. In the present embodiment, the embroidery data that are downloaded from the server 5 to the PC 1 are supplied to the sewing machine 3 through the memory card 115.

Figure 3:
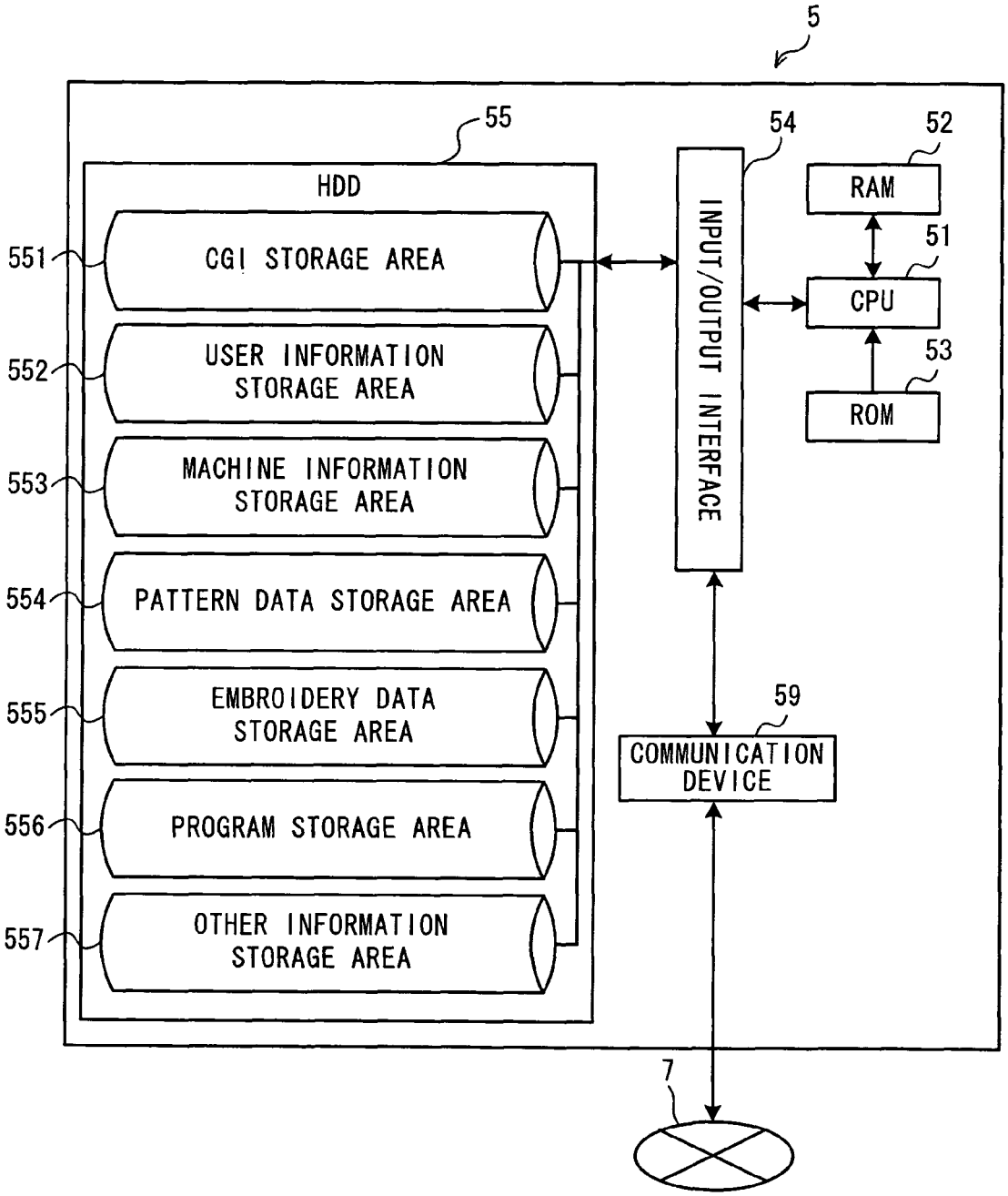
FIG. 3 is a block diagram that shows an electrical configuration of a server device.
Figure 5:
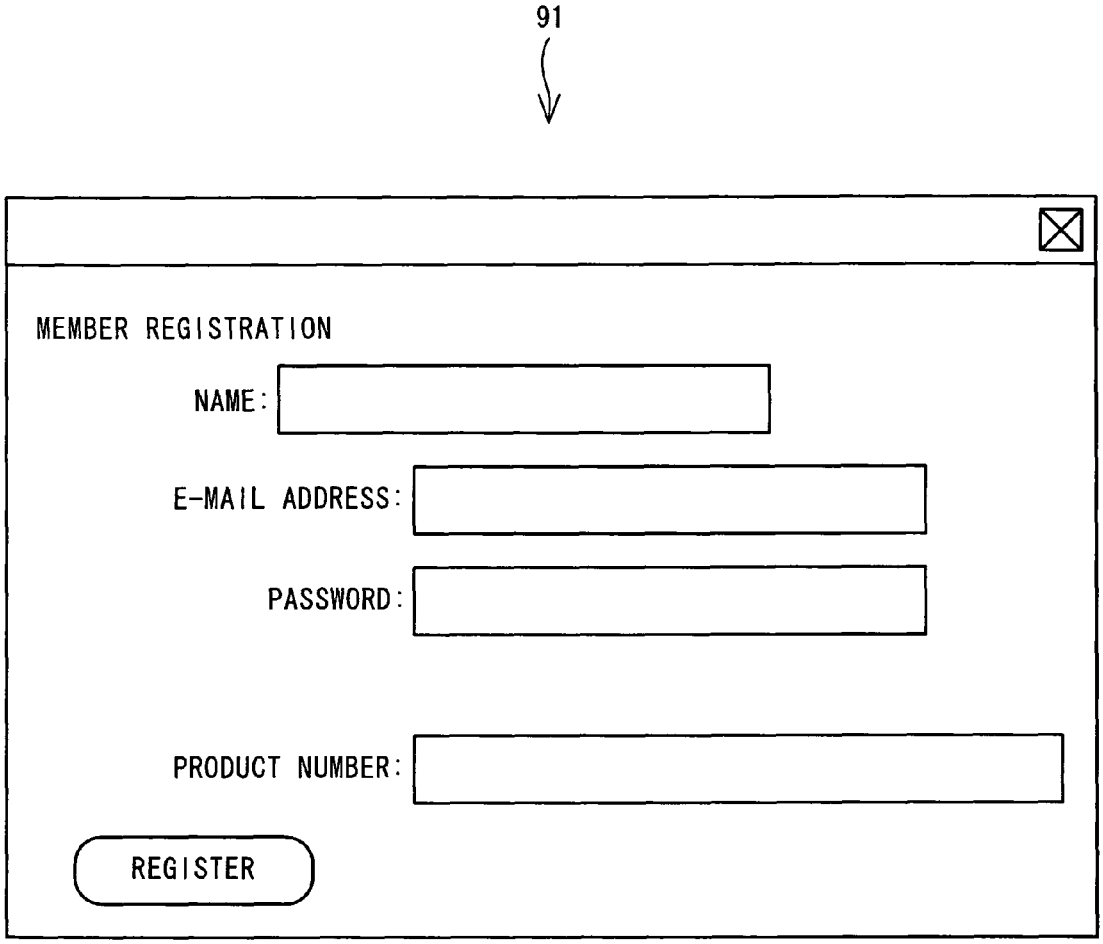
FIG. 5 is a figure that shows an example of a member registration screen.

The server 5 will be explained with reference to FIGS. 1 and 3. As shown in FIGS. 1 and 3, the server 5 has the same sort of configuration as a known server. A RAM 52, a ROM 53, and an input/output interface 54 are connected to a CPU 51 that performs control of the server 5. The RAM 52 stores various types of data temporarily. The ROM 53 stores a BIOS and the like. The input/output interface 54 mediates exchanges of data. A hard disk drive (HDD) 55 and a communication device 59 are connected to the input/output interface 54. At least CGI storage area 551, a user information storage area 552, a machine information storage area 553, a pattern data storage area 554, an embroidery data storage area 555, a program storage area 556, and an other information storage area 557 are provided in the HDD 55. The communication device 59 performs control of communication with another computer (the PC 1 in the present embodiment) through the Internet 7. The server 5 may also be provided with input/output units such as a keyboard, a mouse, a display, and the like that are not shown in the drawings.

A CGI script that is a program for implementing the providing of the embroidery data through the browser is stored in the CGI storage area 551. The CGI script that is stored in the CGI storage area 551 is executed when the server 5 is accessed from the PC 1. It is therefore possible for the user to acquire (download) the embroidery data from the server 5 simply by operating the browser in the PC 1. In other words, in the present embodiment, a special program in the PC 1 that acquires the embroidery data from the server 5 is not required in order to acquire the embroidery data.

A user information database 200 is stored in the user information storage area 552. Information (user information) that pertains to users who can receive the embroidery data from the server 5 is stored in the user information database 200. For example, the user information that is stored in the user information database 200 includes a user name, an e-mail address, a password, a product number, and the like, as shown in FIG. 4. The product number indicates an identification code that is unique to the sewing machine 3.

In the present embodiment, the user of the PC 1, before receiving the embroidery data from the server 5 for the first time, accesses the server 5 in advance and carries out member registration from a member registration screen. For example, the user inputs the user's own user name, own e-mail address, a freely chosen password, and the product number of the sewing machine 3 that the user owns on a member registration screen like that shown in FIG. 5. When the user clicks on "Register" on the member registration screen (FIG. 5), the information that has been input is transmitted from the PC 1 to the server 5. In the server 5, the user information that includes the information that was input is registered in the user information database 200.

A machine information database 300 is stored in the machine information storage area 553. Information (machine information) that pertains to the sewing machine 3 in which the embroidery data that is provided from the server 5 will be used is stored in the machine information database 300. For example, the machine information that is stored in the machine information database 300 includes a product number, a model, at least one embroiderable frame size, and the like, as shown in FIG. 6. The product number indicates an identification code that is unique to the sewing machine 3. The model indicates the product model of the sewing machine 3. The at least one embroiderable frame size indicates the size of an embroidery frame that can be used on the sewing machine 3. The sewing machine 3 is capable of performing embroidery sewing within a range of frame sizes that is indicated by the at least one embroiderable frame size. To put it another way, the at least one embroiderable frame size indicates the size of the embroidery pattern that can be sewn on the sewing machine 3. In the present embodiment, the manager of the server 5, the manufacturer of the sewing machine 3, or the like registers in advance in the machine information database 300 the machine information for each sewing machine 3 that has been one of manufactured and sold.

Pattern data that are templates of embroidery patterns that the user can use are stored in the pattern data storage area 554. The user can use the pattern data that are stored in the pattern data storage area 554 when the user edits the embroidery pattern on an edit screen (refer to FIGS. 12 and 13) that will be described later. The embroidery data that are created in the server 5 are stored in the embroidery data storage area 555 in association with the user who commanded that the embroidery data be created. At least a program (an embroidery data providing program) that performs a series of processes for providing the embroidery data is stored in the program storage area 556. Other information that is used by the server 5 is stored in the other information storage area 557.

A configuration of the sewing machine 3 will be explained with reference to FIG. 1. As shown in FIG. 1, the sewing machine 3 is provided with a bed portion 30, an embroidery frame 31, a Y direction drive portion 32, a main body case 33, an X direction drive mechanism (not shown in the drawings), a sewing needle 34, a needle bar 35, a shuttle mechanism (not shown in the drawings), and the like. The embroidery frame 31 is disposed on the bed portion 30 and holds a work cloth on which embroidery sewing will be performed. The X direction drive mechanism (not shown in the drawings) is accommodated within the main body case 33. The Y direction drive portion 32 and the X direction drive mechanism (not shown in the drawings) move the embroidery frame 31 to a position that is indicated by an XY coordinate system that is specific to the sewing machine 3. In conjunction with the moving of the embroidery frame 31, the needle bar 35 in which the sewing needle 34 is mounted and the shuttle mechanism (not shown in the drawings) perform sewing on the work cloth that is held by the embroidery frame 31. The Y direction drive portion 32, the X direction drive mechanism, the needle bar 35, and the like are controlled by a control unit (not shown in the drawings) that is configured from a microcomputer or the like that is built into the sewing machine 3.

A memory card slot 37 in which the memory card 115 can be mounted is provided on a side face of a pillar 36 of the sewing machine 3. When the memory card 115, in which the embroidery data are stored, is mounted in the memory card slot 37, the embroidery data are supplied to the sewing machine 3. The control unit (not shown in the drawings) of the sewing machine 3 automatically performs the embroidery operation described above based on the embroidery data that are supplied from the memory card 115.

Figure 7:
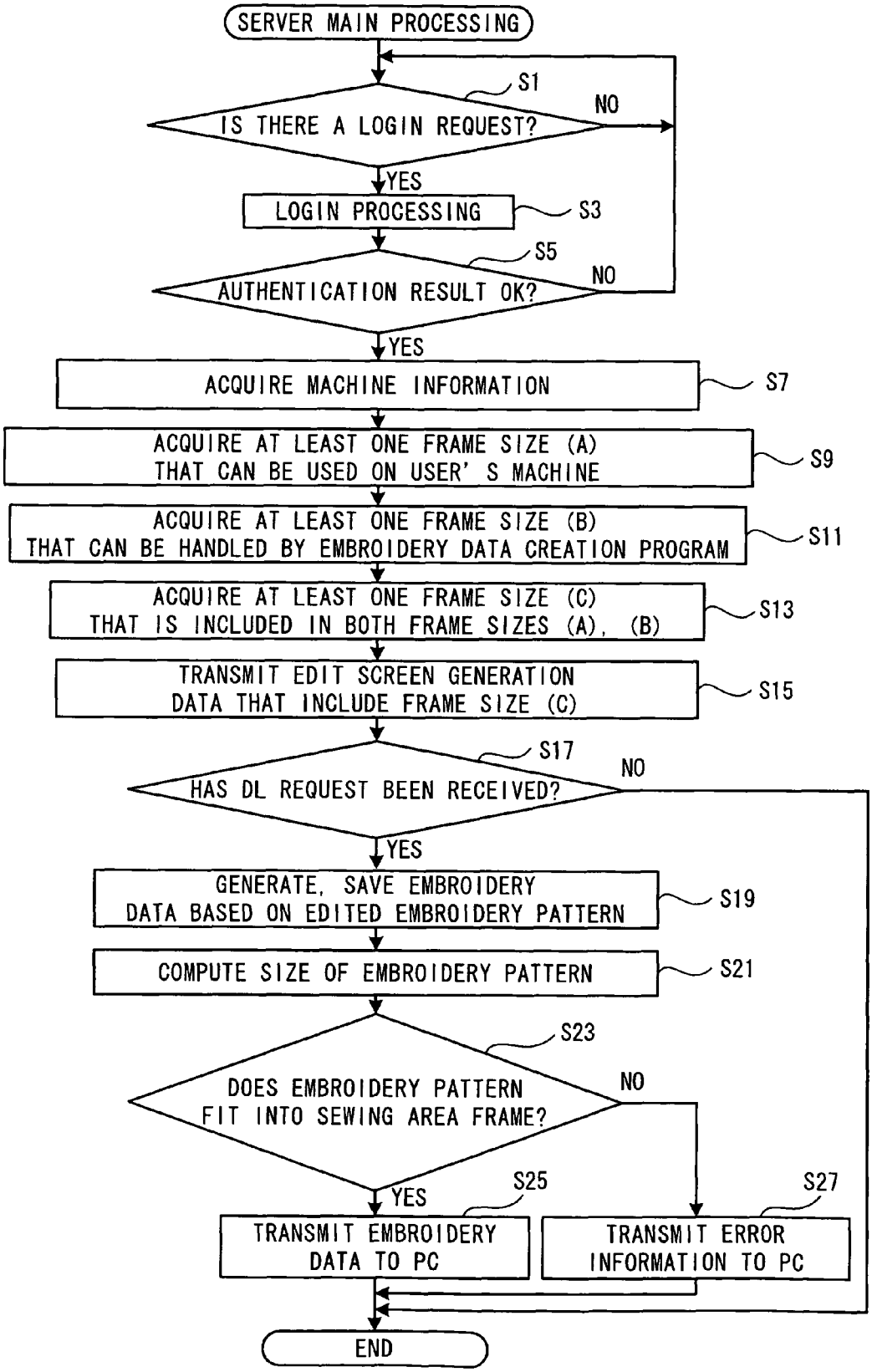
FIG. 7 is a flowchart that shows main processing in the server device.

The series of processes by which the embroidery data are provided from the server 5 to the PC 1 in the embroidery data providing system 100 will be explained with reference to FIGS. 7 and 8, with the main processing that is performed by the PC 1 and the main processing that is performed by the server 5 being explained separately. The main processing in the server 5 that is shown in FIG. 7 is performed by the CPU 51, based on the embroidery data providing program, when the server 5 is accessed from the PC 1. The main processing in the PC 1 is performed by the CPU 11 when the browser is started by a user operation and access to the server 5 is performed.

As shown in FIG. 7, in the main processing in the server 5, first, a determination is made as to whether an access from the PC 1 is a login request (Step S1). In a case where the access from the PC 1 is a login request (YES at Step S1), login processing is performed in relation to the user of the PC 1 (Step S3). In the login processing at Step S3, first, the server 5 displays a login screen on the PC 1.

Figure 8:
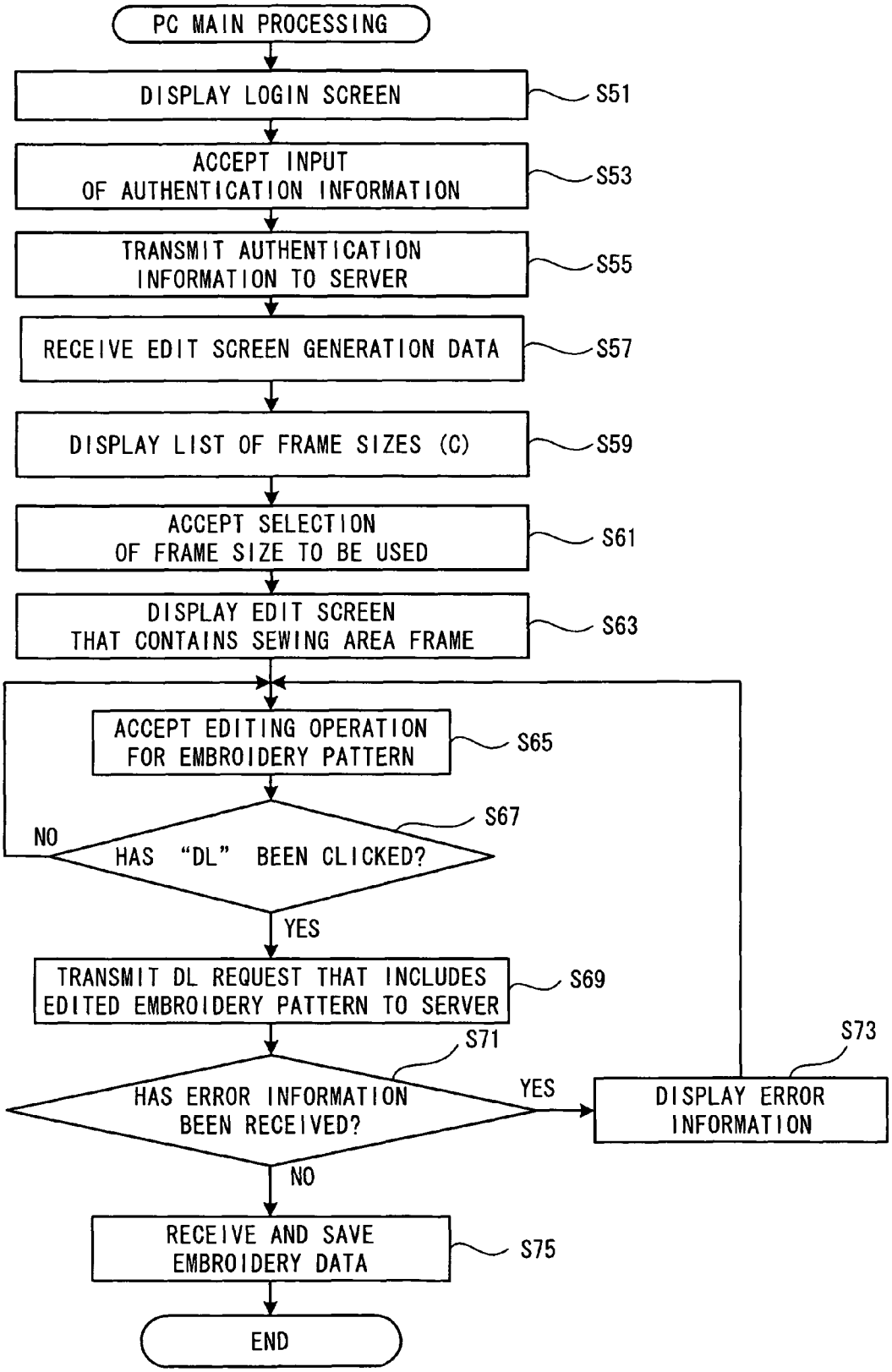
FIG. 8 is a flowchart that shows main processing in the PC according to the first embodiment.
Figure 9:
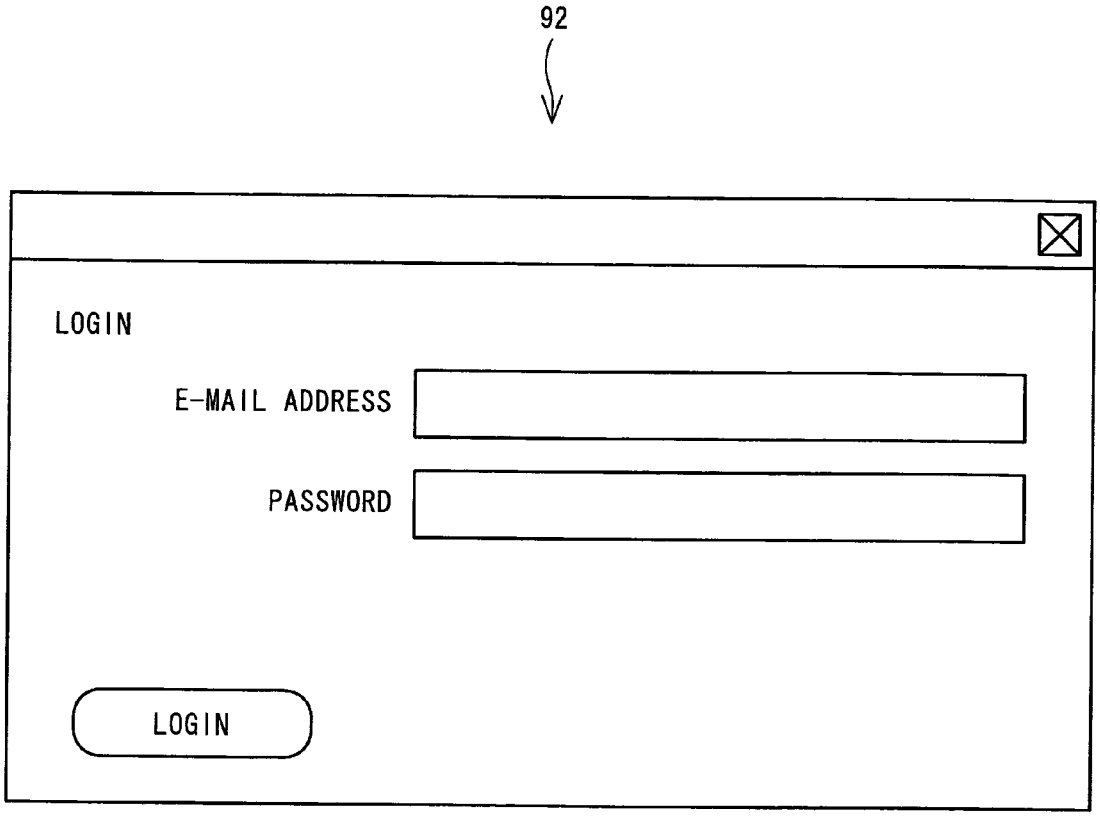
FIG. 9 is a figure that shows an example of a login screen.

As shown in FIG. 8, in the main processing in the PC 1, the login screen is displayed in the browser on the display 24 (Step S51) in response to the login processing of the server 5 (Step S3). The login screen is a screen for inputting information (authentication information) for verifying whether the user of the PC 1 is a legitimate user who is registered as a member. For example, on a login screen 92 that is shown in FIG. 9, input spaces are provided for inputting an e-mail address and a password as the authentication information.

When the input of the authentication information on the login screen is accepted (Step S53), the authentication information that was input on the login screen is transmitted to the server 5 (Step S55). In the case of the login screen 9 that is shown in FIG. 9, when the user of the PC 1 inputs the e-mail address and the password and clicks on the "Login" button, the e-mail address and the password that were input on the login screen 9 are transmitted to the server 5.

Returning to FIG. 7, in the login processing at Step S3, when the server 5 receives the authentication information from the PC 1, a login authentication is performed based on the authentication information. Specifically, if the user information that is registered in the user information database 200 includes an e-mail address and a password that match the authentication information that was received from the PC 1, the user of the PC 1 is verified to be a legitimate user. In a case where the authentication result of the login processing at Step S3 is "OK" (in other words, in a case where the user is verified to be a legitimate user) (YES at Step S5), the user of the PC 1 is allowed to log in.

If the user information that is registered in the user information database 200 does no include an e-mail address and a password that match the authentication information that was received from the PC 1, the user of the PC 1 is not a legitimate user, so the authentication result is "NG" (No at Step S5). In this case, the user of the PC 1 is not allowed to log in, the server 5 displays an error on the PC 1 that indicates that the authentication has failed, for example, and the processing returns to Step S1. The processing also returns to Step S1 in a case where there is no login request (NO at Step S1).

When the user of the PC 1 is allowed to log in, the machine information that corresponds to the user information is acquired (Step S7). More specifically, the product number in the user information that corresponds to the user who was allowed to log in is acquired from the user information database 200. The machine information that includes the product number is acquired from the machine information database 300. In the example that is shown in FIGS. 4 and 6, in a case where a user ABCD was allowed to log in, the machine information that includes the product number 01234567890123 is acquired.

Next, at least one frame size (A) that can be used on the sewing machine 3 that the user of the PC 1 has is acquired (Step S9). More specifically, the at least one embroiderable frame size in the machine information that was acquired at Step S7 is acquired as the at least one frame size (A). At least one frame size (B) that can be handled by an embroidery data providing program in the server 5 is acquired (Step S11). To put it another way, at least one frame size for the embroidery data that can be created by the embroidery data providing program, which is stored in the program storage area 556, is acquired as the at least one frame size (B). At least one frame size (C) is acquired that is included in both the at least one frame size (A) that was acquired at Step S9 and the at least one frame size (B) that was acquired at Step S11 (Step S13).

In the example that is described above, the embroiderable frame sizes in the machine information that contains the product number 01234567890123 are 10 centimeters by 10 centimeters, 13 centimeters by 18 centimeters, 20 centimeters by 30 centimeters, and 50 centimeters by 10 centimeters, and they are acquired as the frame sizes (A) at Step S9. Further, the frame sizes that can be handled by and are set in advance in the embroidery data providing program are 10 centimeters by 10 centimeters, 13 centimeters by 18 centimeters, 20 centimeters by 30 centimeters, and 50 centimeters by 50 centimeters, and they are acquired as the frame sizes (B) at Step S11. Once this is done, the frame sizes 10 centimeters by 10 centimeters, 13 centimeters by 18 centimeters, and 20 centimeters by 30 centimeters that are common to both the frame sizes (A) and the frame sizes (B) are acquired as the frame sizes (C) at Step S13.

The sewing machine 3 that the user of the PC 1 has may be capable of performing embroidery sewing on a special frame size (in the example that is described above, 50 centimeters by 10 centimeters), depending on its use, the model, and the like. In the present embodiment, the embroidery data providing program that is executed by the server 5 is a program for providing embroidery data that are compatible with general-purpose frame sizes that are used in common by a plurality of types of sewing machines. Therefore, at Step S13 that is described above, the frame sizes for the embroidery data that can be provided by the server 5 are limited to the general-purpose frame sizes (B) that the embroidery data providing program can handle.

Next, edit screen generation data that include the frame sizes (C) that were acquired at Step S13 are transmitted to the PC 1 (Step S15). The edit screen generation data are data that cause an edit screen that will be described later to be displayed on the PC 1. In addition to the frame sizes (C), the edit screen generation data include screen data for generating the edit screen, pattern data that can be used on the edit screen, and the like. The screen data that are included in the edit screen generation data are set by being read from the other information storage area 557. The pattern data that are included in the edit screen generation data are set by being read from the pattern data storage area 554. In the example that is described above, the frame sizes (C) that are included in the edit screen generation data are 10 centimeters by 10 centimeters, 13 centimeters by 18 centimeters, and 20 centimeters by 30 centimeters.

Figure 10:
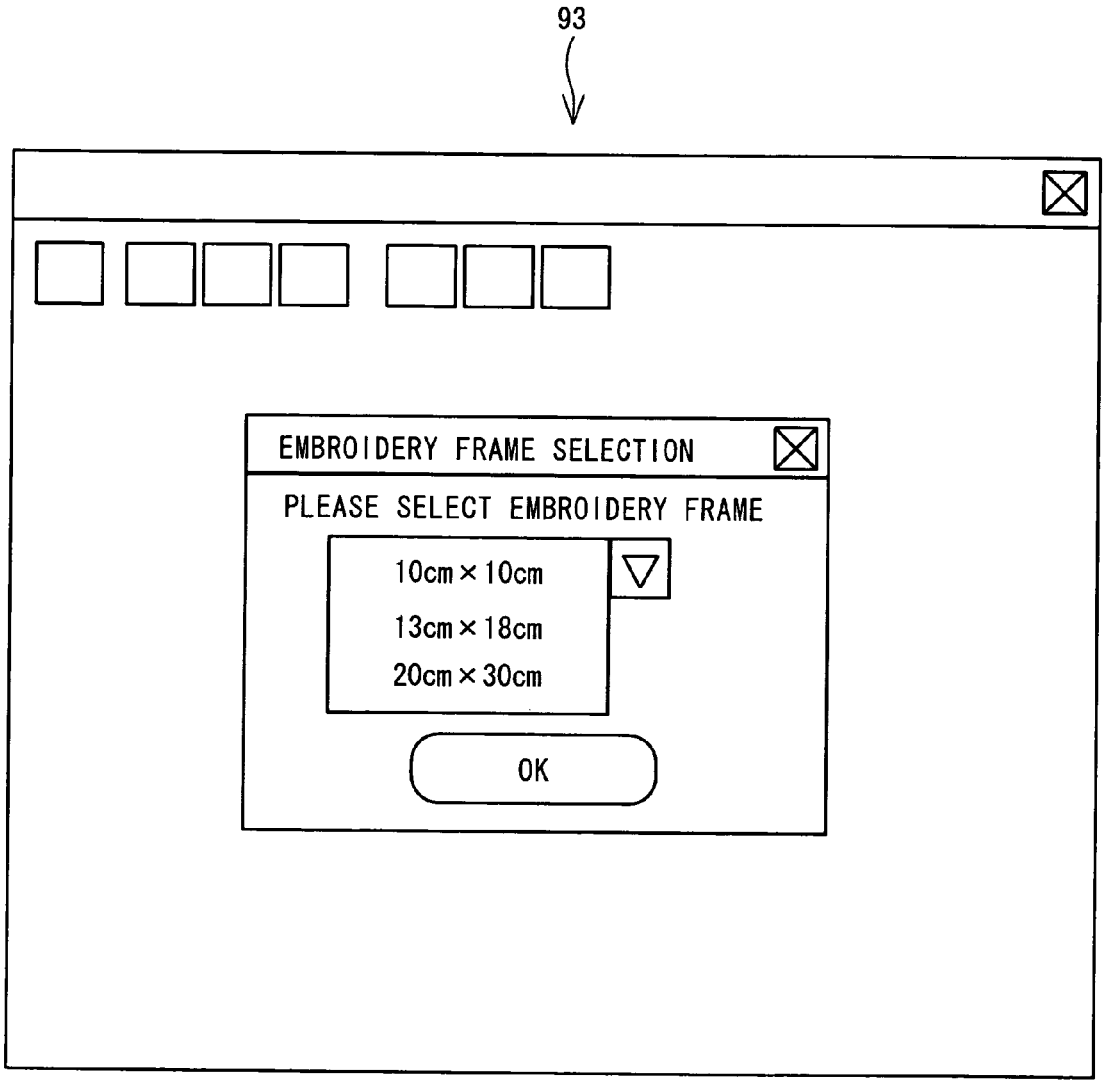
FIG. 10 is a figure that shows an example of an embroidery frame selection screen.

Returning to FIG. 8, in the main processing in the PC 1, when the edit screen generation data are received from the server 5 (Step S57), a list of the frame sizes (C) that are included in the edit screen generation data that was received at Step S57 is displayed by the browser (Step S59). For example, as on an embroidery frame selection screen 93 that is shown in FIG. 10, a list may be displayed of the three frame sizes (C) that are included in the edit screen generation data (that is, 10 centimeters by 10 centimeters, 13 centimeters by 18 centimeters, and 20 centimeters by 30 centimeters). The user can select any one of the frame sizes from the list that is displayed by the browser.

Figure 11:
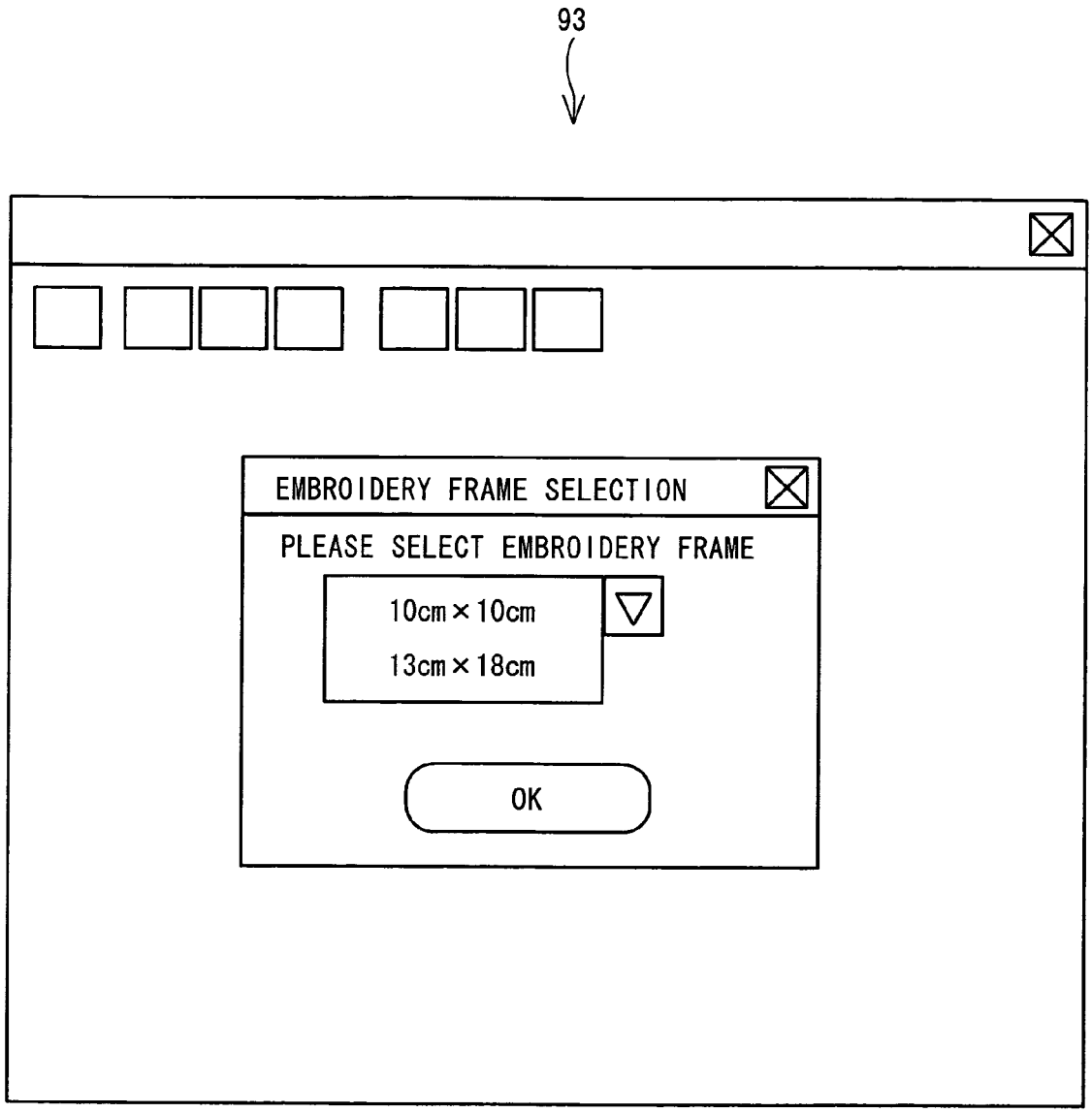
FIG. 11 is another figure that shows an example of an embroidery frame selection screen.

If the user of the PC 1 who has logged in to the server 5 is EFGH, then the edit screen generation data that are transmitted to the PC 1 in the same manner as at Steps S7 to S15 that are described above include 10 centimeters by 10 centimeters and 13 centimeters by 18 centimeters as the frame sizes (C) (refer to FIGS. 4 and 6). In that case, a list of two frame sizes (10 centimeters by 10 centimeters and 13 centimeters by 18 centimeters) is displayed, as on the embroidery frame selection screen 93 that is shown in FIG. 11.

A selection, from among the frame sizes (C) that are displayed in list form at Step S59, of a frame size to be used in editing the embroidery pattern (hereinafter called the used frame size) is accepted (Step S61). In concrete terms, the user uses one of the mouse 22 and the keyboard 21 to select one of the frame sizes (C) that are displayed by the browser at Step S59, and the user's selection is detected. Once the selection is accepted, an edit screen that contains a sewing area frame is displayed by the browser (Step S63). The edit screen is an operation screen for allowing the user of the PC 1 to edit the embroidery pattern. At Step S63, the edit screen is generated and display based on the screen data that are included in the edit screen generation data. The sewing area frame is a display area that corresponds to the used frame size that has been selected by the user of the PC 1 and that graphically shows a range in which the user can arrange the embroidery pattern. An editing operation that the user performs on the embroidery pattern is accepted on the edit screen (Step S65). On the edit screen in the present embodiment, the pattern data that are included in the edit screen generation data are displayed as a template of the embroidery pattern, although this is not shown in the drawings. The user can edit the embroidery pattern by arranging and modifying the pattern data on the edit screen. On the edit screen, when a Download (DL) button that is not shown in the drawings is clicked (YES at Step S67), a download request (a DL request) that includes the edited embroidery pattern on the edit screen, the used frame size, and the like is transmitted to the server 5 (Step S69).

Figure 12:
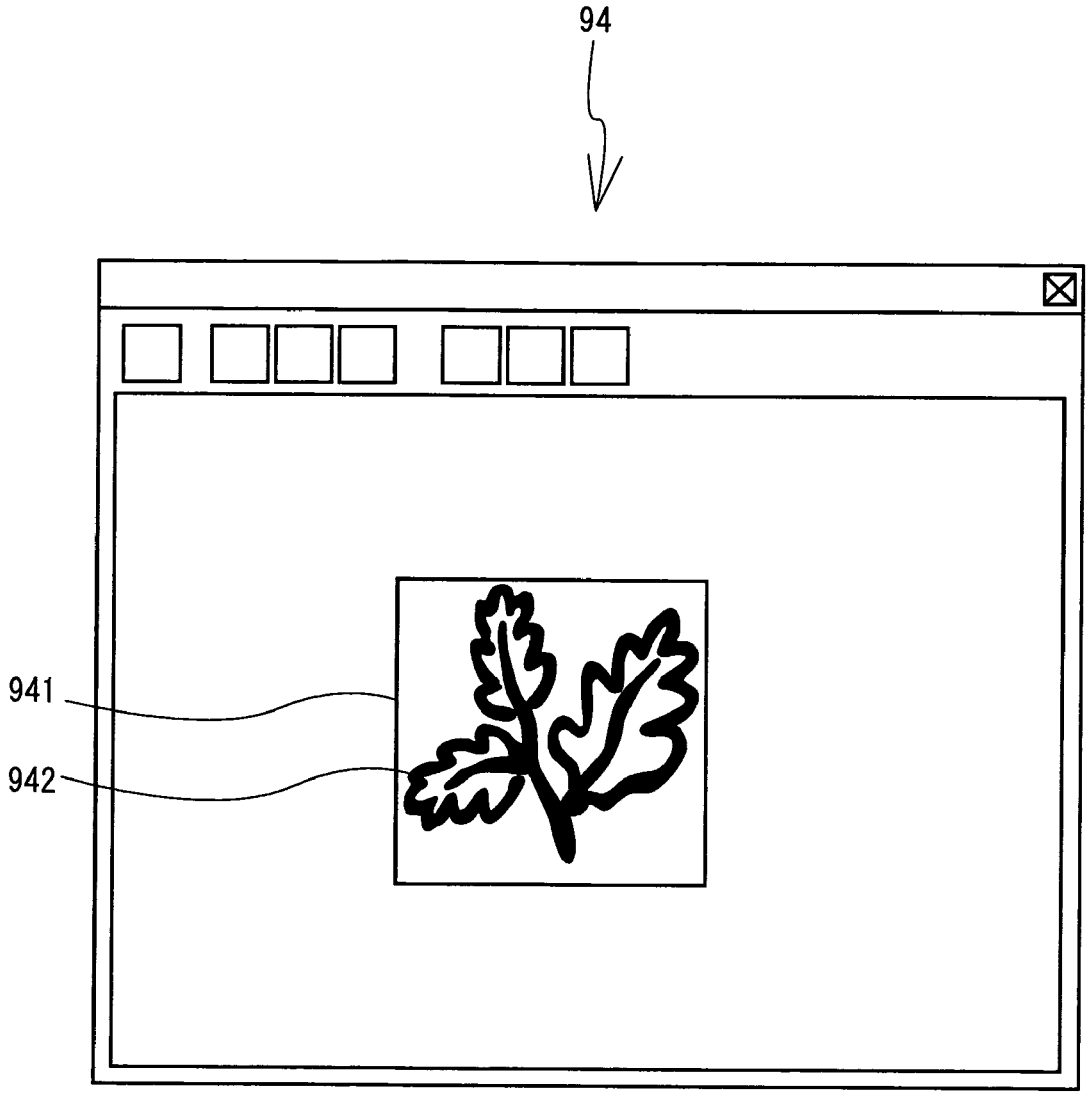
FIG. 12 is a figure that shows an example of an edit screen.
Figure 13:
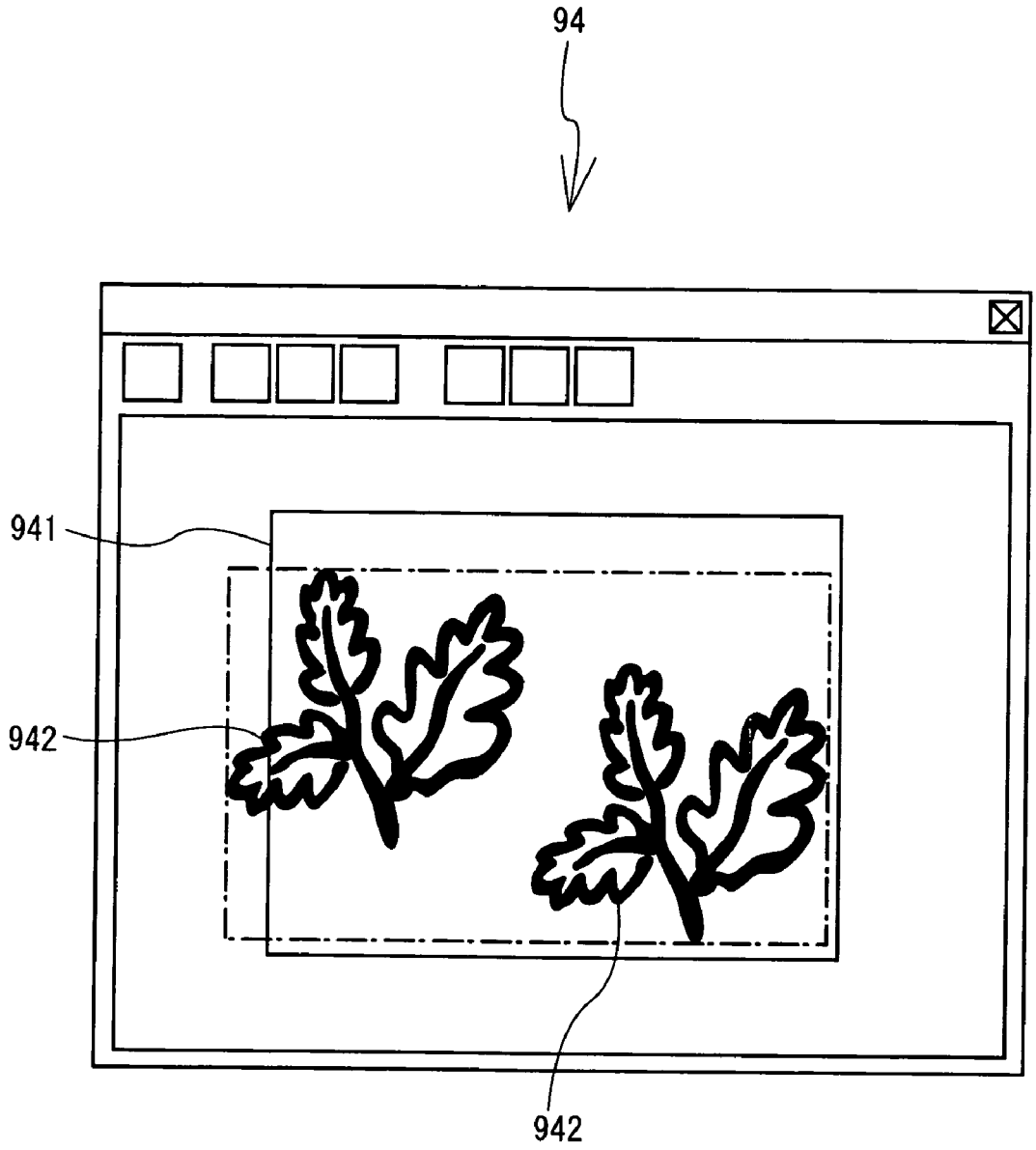
FIG. 13 is another figure that shows an example of an edit screen.

In the example of an edit screen 94 that is shown in FIG. 12, a sewing area frame 941 is displayed that graphically shows a 10-centimeter-by-10-centimeter range that is displayed at Step S63 in response to the selection of 10 centimeters by 10 centimeters as the used frame size at Step S61. In the example of the edit screen 94 that is shown in FIG. 13, the sewing area frame 941 that is displayed graphically shows a 13-centimeter-by-18-centimeter range that is displayed at Step S63 in response to the selection of 13 centimeters by 18 centimeters as the used frame size at Step S61. The user of the PC 1 can perform an editing operation for arranging and processing an embroidery pattern 942 as desired within the range of the sewing area frame 941 (Step S65). By clicking on the Download button after the embroidery pattern 942 is edited, the user can issue a request to the server 5 to download the embroidery data for sewing the embroidery pattern 942 (Step S67).

Returning to FIG. 7, in the main processing in the server 5, when the DL request is received from the PC 1 (YES at Step S17), the embroidery data are generated by a known method, based on the edited embroidery pattern that is included in the DL request (Step S19). The embroidery data are the data that are used when the embroidery sewing is performed by the sewing machine 3. Information that indicates a color code, an embroidering position, and an embroidery size, as well as stitch data that indicate the stitches for carrying out the embroidery, are included in the embroidery data. The newly generated embroidery data are stored in the embroidery data storage area 555 in association with the user who requested the embroidery data. Storing the embroidery data this way in the server 5 in association with the user makes it possible for the user of the PC 1 to access the server 5 at a later time and download the embroidery data that the user created in the past.

Next, the size of the edited embroidery pattern (hereinafter called the edited pattern size) is computed (Step S21). For example, the edited pattern size may be specified by the vertical and horizontal lengths of the smallest rectangle that encloses all of the embroidery patterns. In the example of the edit screen 94 that is shown in FIG. 12, there is one of the embroidery pattern 942, so the vertical and horizontal lengths (9 centimeters by 9 centimeters) of the embroidery pattern 942 are specified as the edited pattern size. In the example of the edit screen 94 that is shown in FIG. 13, there are two of the embroidery patterns 942, so the vertical and horizontal lengths (11 centimeters by 20 centimeters) of the smallest rectangle that encloses all of the embroidery patterns 942 (indicated by the broken line in FIG. 13) are specified as the edited pattern size.

Next, a determination is made as to whether the edited embroidery pattern will fit into the sewing area frame that is displayed on the edit screen (Step S23). Specifically, a determination is made as to whether the edited pattern size that was computed at Step S21 is not greater than the used frame size that is included in the DL request. In a case where it is determined that the edited embroidery pattern will fit into the sewing area frame (YES at Step S23), the embroidery data that were generated at Step S19 are transmitted to the PC 1 (Step S25). In a case where the server 5 provides (that is, sells) the embroidery data for a fee, billing to the user of the PC 1 is performed at Step S25. In a case where it is determined that the edited embroidery pattern will not fit into the sewing area frame (NO at Step S23), the transmission (the download) of the embroidery data is restricted, and specified error information is transmitted to the PC 1 (Step S27). In a case where one of the embroidery data and the specified error information is transmitted to the PC 1 (one of Step S25 and Step S27), as well as in a case where the download request is not received (NO at Step S17), the main processing in the server 5 is terminated.

In the example of the edit screen 94 that is shown in FIG. 12, the edited pattern size of 9 centimeters by 9 centimeters is smaller than the sewing area frame (the used frame size) of 10 centimeters by 10 centimeters. Therefore, it is determined that the edited embroidery pattern will fit into the sewing area frame, and the embroidery data are transmitted to the PC 1 (YES at Step S23; Step S25). In the example of the edit screen 94 that is shown in FIG. 13, the edited pattern size of 11 centimeters by 20 centimeters is longer horizontally than the sewing area frame (the used frame size) of 13 centimeters by 18 centimeters. Therefore, it is determined that the edited embroidery pattern will not fit into the sewing area frame, and the error information is transmitted to the PC 1 (NO at Step S23; Step S27).

At Step S23 in the present embodiment, the determination as to whether the embroidery pattern will fit into the sewing area frame is made based on the edited pattern size that is computed at Step S21, but the method of making the determination is not limited to this example. For example, at Step S69 in the PC 1, coordinate information that indicates the position of the edited embroidery pattern in relation to the sewing area frame may also be included in the DL request that is described above and transmitted to the server 5. In that case, at Step S23 in the server 5, the determination as to whether the embroidery pattern will fit into the sewing area frame may also be made based on the coordinate information for the embroidery pattern that is included in the DL request.

Figure 14:
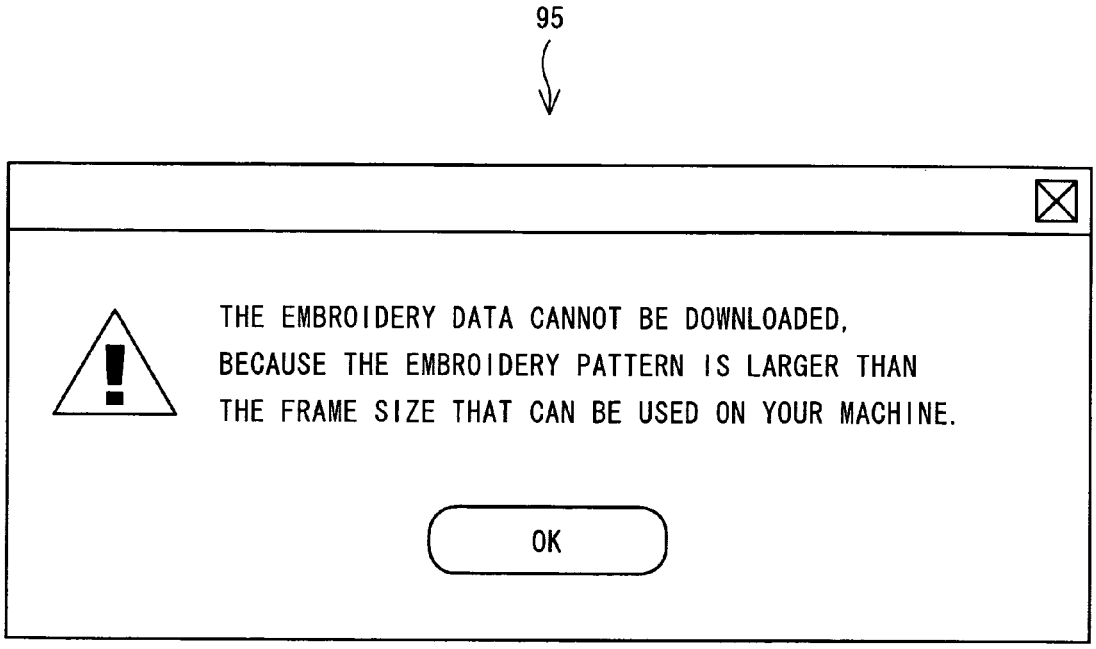
FIG. 14 is a figure that shows an example of an error screen.

Returning to FIG. 8, in the main processing in the PC 1, after the DL request has been transmitted to the server 5, a determination is made as to whether the specified error information has been received (Step S71). In a case where the specified error information has been received from the server 5 (YES at Step S71), the specified error information is displayed by the browser (Step S73). For example, as in an error screen 95 that is shown in FIG. 14, the embroidery pattern that has been edited by the user of the PC 1 is larger than the frame size that can be used on the sewing machine 3, so a message is displayed to the effect that the embroidery data cannot be downloaded to the PC 1. In this case, the processing returns to Step S65, and the editing operation on the embroidery pattern is performed again by the user. In a case where the specified error information has not been received from the server 5 (NO at Step S71), the embroidery data are received from the server 5 and are stored in the embroidery data storage area 151 (Step S75). Once the embroidery data have been stored, the main processing in the PC 1 is terminated.

In the PC 1 that has received the embroidery data from the server 5, in response to a user operation that is performed at any given time, the embroidery data that are stored in the embroidery data storage area 151 is written to the memory card connector 23. The user mounts the memory card 115 in the sewing machine 3, and the embroidery data are read. In the sewing machine 3, an embroidery operation is performed based on the embroidery data that have been read from the memory card 115. Thus the embroidery pattern that the user has edited on the edit screen is properly sewn on the work cloth within the embroidery frame 31 (refer to FIG. 1).

As explained above, according to the embroidery data providing system 100 according to the first embodiment, when the authentication information that is unique to the user is input in the PC 1, the at least one frame size (A) that indicates the size of the embroidery pattern that can be embroidered by the user's sewing machine 3, the at least one frame size (B) that can be handled by the embroidery data providing program, and the at least one frame size (C) that is included in both the at least one frame size (A) and the at least one frame size (B) are acquired by the server 5. Furthermore, if the embroidery pattern is edited within the sewing area frame on the edit screen in the PC 1, the embroidery data for sewing the embroidery pattern are generated in the server 5 and transmitted to the PC 1. In other words, the embroidery data for performing excellent embroidery sewing on the user's sewing machine 3 are downloaded to the PC 1. On the other hand, if the embroidery pattern is edited such that it is larger than the sewing area frame on the edit screen in the PC 1, the embroidery data are not transmitted to the PC 1 by the server 5. In other words, the downloading to the PC 1 of the embroidery data that are not suitable (or that cannot be used) for embroidery sewing on the user's sewing machine 3 is restricted.

In the PC 1, a list of the at least one frame size (C) is output to the display 24. The edit screen on which the user performs the editing operation on the embroidery pattern includes the sewing area frame that graphically shows the frame size that has been selected by the user. It is therefore possible for the user to edit the embroidery pattern while being graphically cognizant of the sewing area frame, thus making it possible to keep the edited embroidery pattern from exceeding the range within which the user's sewing machine 3 can perform the sewing. Furthermore, even in a case where the user's sewing machine 3 is compatible with a plurality of the frame sizes (C), it is possible for the user to visually recognize only the frame size that the user has selected.

Moreover, in the server 5, the user's authentication information can be acquired in the login processing at Step S3. Once the authentication information is acquired, the product number that corresponds to the user's authentication information is acquired from the user information database 200. In addition, the model that corresponds to the product number is acquired from the machine information database 300 (refer to FIG. 7). It is thus possible for the user of the PC 1 to forgo the effort of inputting the product number and the model every time that the server 5 is accessed. However, the user of the PC 1 may also input the product number and the model every time that the server 5 is accessed. In this case, the processing that acquires the product number from the user information database 200 based on the user's authentication information becomes unnecessary.

Next, a second embodiment of the present disclosure will be explained with reference to FIGS. 15 to 17.

In the second embodiment, unlike in the first embodiment, the server 5 and the Internet 7 are not included in the configuration. When the user edits the embroidery pattern by operating a PC 9, the embroidery data are generated and stored in the PC 9. The embroidery data that are stored in the PC 9 are supplied to the sewing machine 3 through a portable memory (for example, the memory card 115). In the explanation that follows, configuring elements that are the same as in the first embodiment are denoted by the same reference numerals, and their explanations will be omitted, with only the points that are different from the first embodiment being explained.

Figure 15:
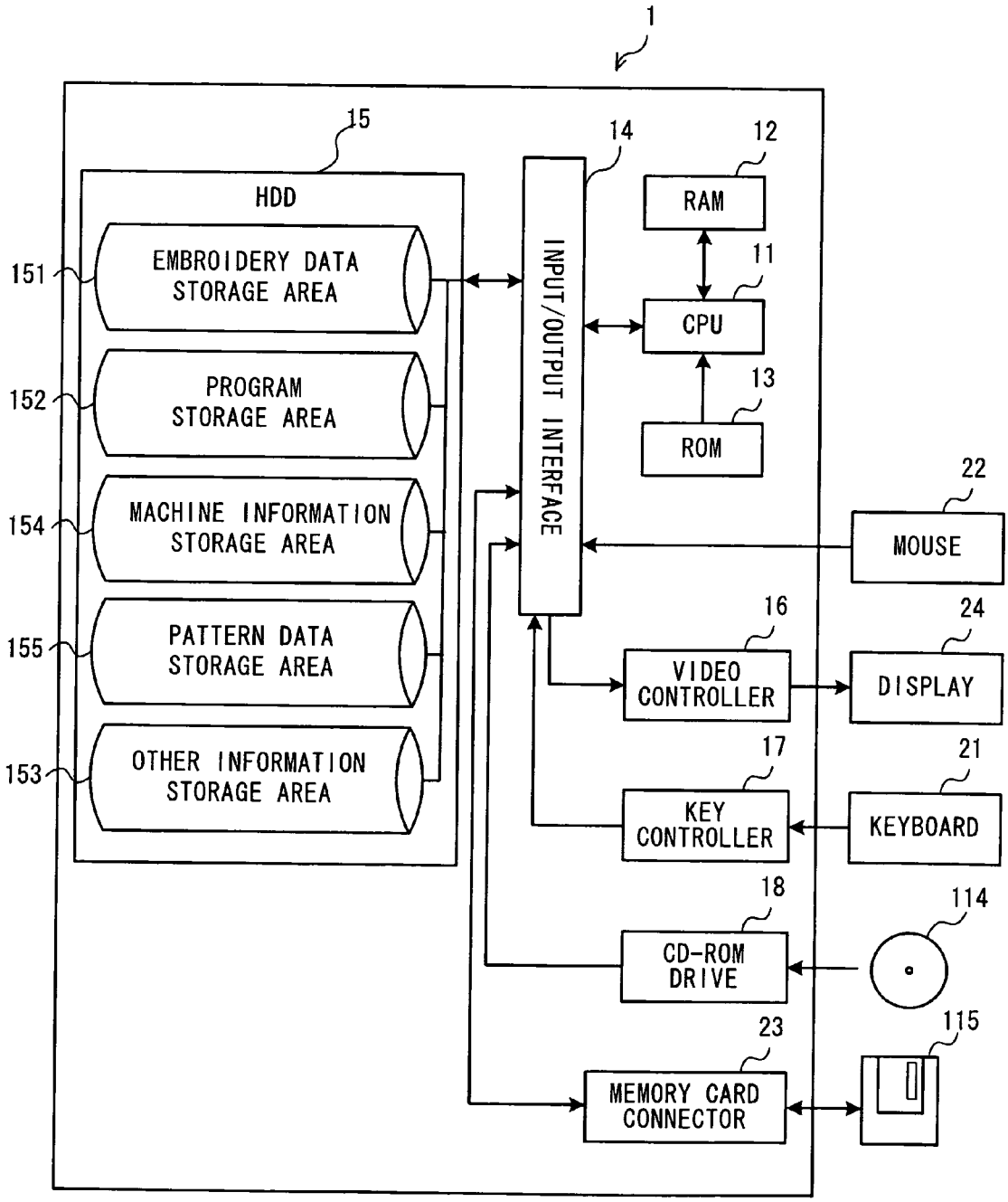
FIG. 15 is a block diagram that shows an electrical configuration of a PC according to a second embodiment.

As shown in FIG. 15, the PC 9 in the present embodiment basically has the same sort of configuration as the PC 1 according to the first embodiment (refer to FIG. 2), but the points described below are different. It is acceptable for the PC 9 not to be provided with the communication device 19 for connecting to the Internet 7 (refer to FIG. 2). At least a program (the embroidery data providing program) that performs a series of processes for generating and storing the embroidery data is stored in the program storage area 152 of the HDD 15. In addition to being provided with functions that perform the generating and the storing of the embroidery data, the embroidery data providing program in the present embodiment is provided with a function that provides a user interface of the same sorts as the browser. When the embroidery data providing program is installed, it may be read from the CD-ROM 114 and stored in the program storage area 152.

In addition to the embroidery data storage area 151, the program storage area 152, and the other information storage area 153, a machine information storage area 154 and a pattern data storage area 155 are provided in the HDD 15. The machine information database 300 (refer to FIG. 6) is stored in the machine information storage area 154 in the same manner as it is in the machine information storage area 553 of the first embodiment. Pattern data that are templates of embroidery patterns that can be used on the edit screen are stored in the pattern data storage area 155 in the same manner as they are in the pattern data storage area 554 of the first embodiment. At least machine information that corresponds to the sewing machine 3 that the user of the PC 9 has may be stored in the machine information database 300 in the present embodiment.

The series of processes by which the embroidery data are provided in the PC 9 will be briefly explained with reference to FIG. 16. The main processing in the PC 9 that is shown in FIG. 16 is performed by the CPU 11 when the embroidery data providing program is launched by an operation of the user.

Figure 16:
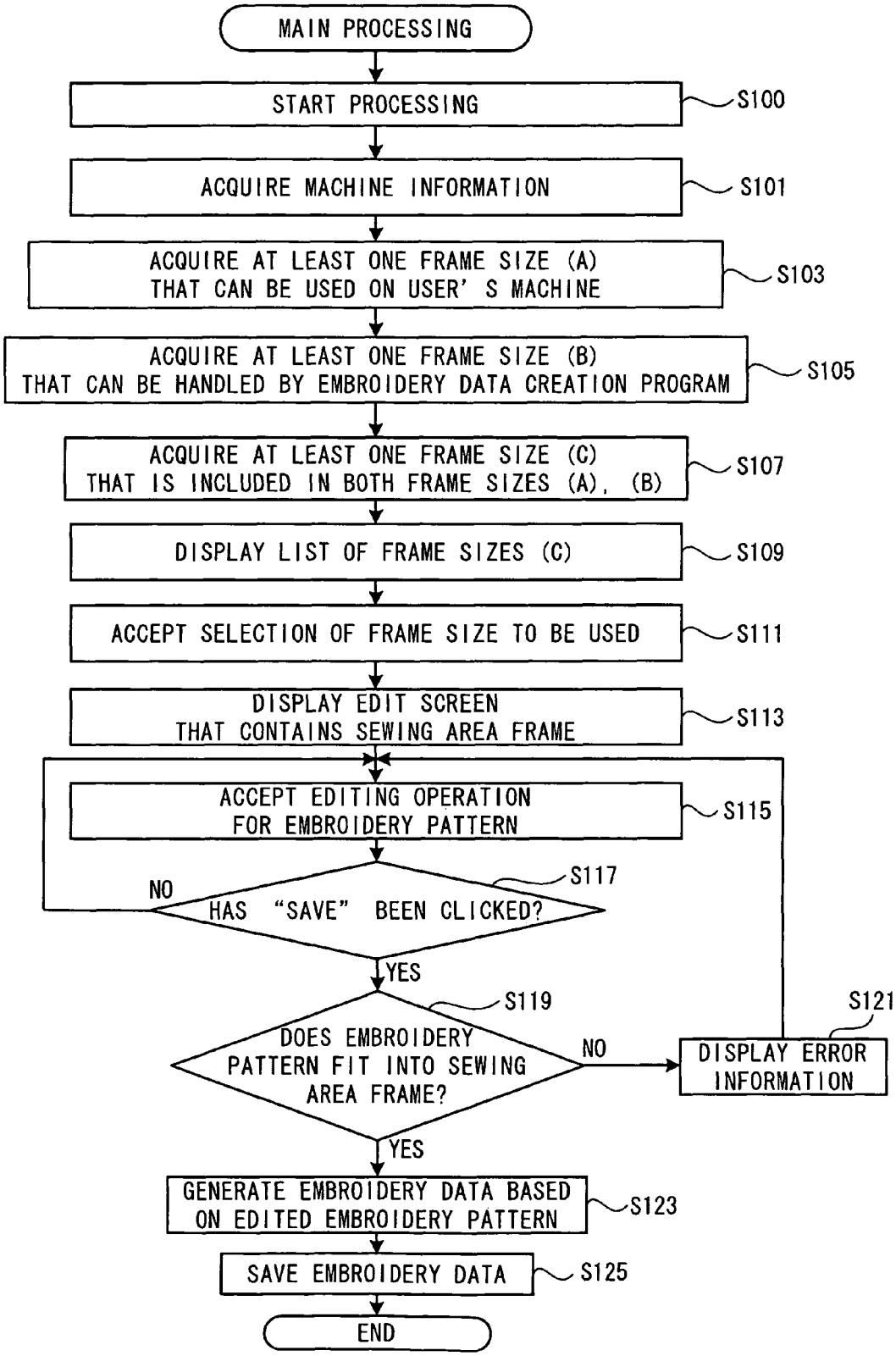
FIG. 16 is a flowchart that shows main processing in the PC according to the second embodiment.
Figure 17:
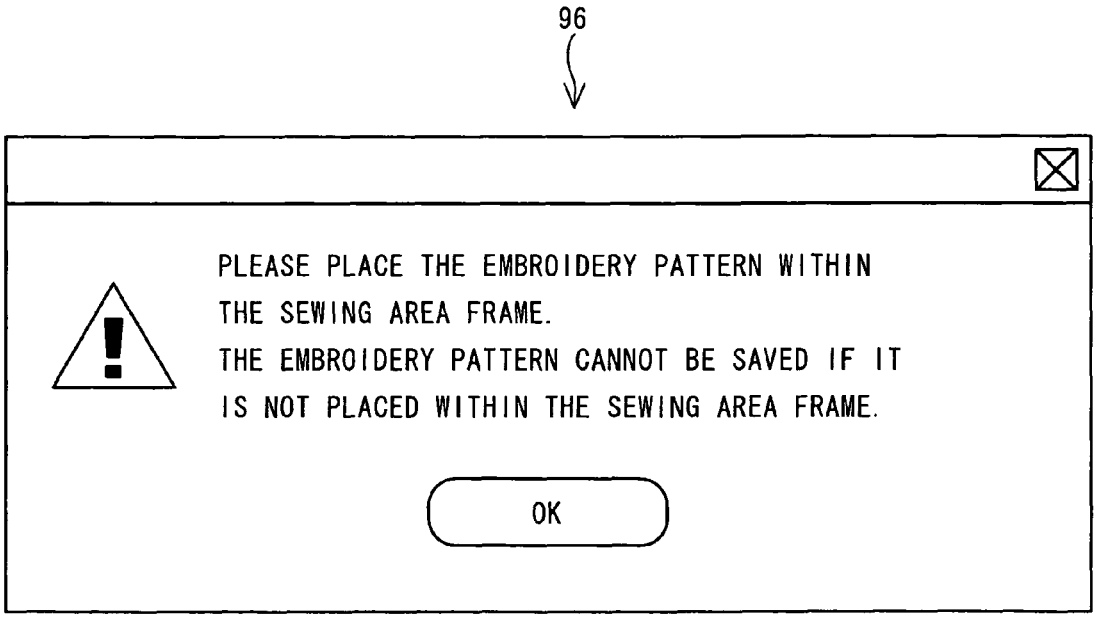
FIG. 17 is a figure that shows an example of an error screen.

As shown in FIG. 16, in the main processing in the present embodiment, first, specified start processing is performed (Step S100). In the start processing, a specified initial screen is displayed on the display 24. The initial screen is provided with a space for inputting the product number, although it is not shown in the drawings. When the product number of the sewing machine 3 that the user has input on the initial screen is accepted, the machine that the user has is acquired (Step S101). More specifically, the machine information that includes the product number that has been input on the initial screen is acquired by referencing the machine information database 300.

Next, in the same manner as in Steps S9 to S13 in the first embodiment, the at least one frame size (A) that can be used on the user's sewing machine 3, the at least one frame size (B) that can be handled by the embroidery data providing program, and the at least one frame size (C) that is included in both the at least one frame size (A) and the at least one frame size (B) are acquired (Steps S103 to S107). In the same manner as at Step S59 (FIG. 8) in the first embodiment, a list of the at least one frame size (C) that was acquired at Step S107 is displayed on the embroidery frame selection screen 93 (refer to FIGS. 10 and 11) that is described above (Step S109). In the same manner as at Steps S61 to S65 (FIG. 8) in the first embodiment, the edit screen 94 (refer to FIGS. 12 and 13) is displayed that includes the sewing area frame that corresponds to the used frame size that has been selected by the user, and the editing operation for the embroidery pattern is accepted (Steps S109 to S115).

When a Save button on the edit screen that is not shown in the drawings is clicked (YES at Step S117), a determination is made as to whether the edited embroidery pattern will fit into the sewing area frame that is displayed on the edit screen (Step S119), in the same manner as at Step S23 (FIG. 7) in the first embodiment. For example, the determination as to whether embroidery pattern will fit into the sewing area frame may be made based on the coordinate information that indicates the position of the edited embroidery pattern in relation to the sewing area frame. The determination as to whether the embroidery pattern will fit into the sewing area frame may also be made by comparing the size of the embroidery pattern and the used frame size, in the same manner as at Steps S21 to S23 (FIG. 7) in the first embodiment.

In a case where it is determined that the edited embroidery pattern will not fit into the sewing area frame (NO at Step S119), the storing (generating) of the embroidery data is restricted, and a specified error screen is displayed on the display 24 (Step S121). For example, as in an error screen 96 that is shown in FIG. 17, the embroidery pattern that has been edited by the user of the PC 9 is larger than the sewing area frame, so a message is displayed to the effect that the embroidery data cannot be stored in the PC 9. In this case, the processing returns to Step S115, and the editing operation on the embroidery pattern is performed again by the user. In a case where it is determined that the edited embroidery pattern will fit into the sewing area frame (YES at Step S119), the embroidery data are generated by a known method, based on the edited embroidery pattern (Step S123). The newly generated embroidery data are stored in the embroidery data storage area 151 (Step S125). Once the embroidery data have been stored, the main processing that is shown in FIG. 16 is terminated.

In the PC 9 in which the embroidery data have been generated and stored, the embroidery data that are stored in the embroidery data storage area 151 are written to the memory card 115 in response to a user operation, in the same manner as in the first embodiment. The user mounts the memory card 115 in the sewing machine 3, and the embroidery data are read. In the sewing machine 3, an embroidery operation is performed based on the embroidery data that have been read from the memory card 115. Thus the embroidery pattern that the user has edited on the edit screen is properly sewn on the work cloth within the embroidery frame 31 (refer to FIG. 1).

As explained above, according to the PC 9 according to the second embodiment, when the product number that is unique to the sewing machine 3 is input, the at least one frame size (C) that is included in both the at least one frame size (A) and the at least one frame size (B) is acquired. Then, when the embroidery pattern is edited within the sewing area frame on the edit screen, the embroidery data for sewing the embroidery pattern are generated. In other words, the embroidery data for performing excellent embroidery sewing on the user's sewing machine 3 are generated in the PC 9. On the other hand, if the embroidery pattern is edited such that it is larger than the sewing area frame on the edit screen, the generating of the embroidery data is not performed. In other words, the generating in the PC 9 of the embroidery data that are not suitable (or that cannot be used) for embroidery sewing on the user's sewing machine 3 is restricted.

Next, in the PC 9, a list of the at least one frame size (C) is output to the display 24. The edit screen on which the user performs the editing operation on the embroidery pattern includes the sewing area frame that graphically shows the frame size that has been selected by the user. It is therefore possible for the user to edit the embroidery pattern while being graphically cognizant of the sewing area frame, thus making it possible to keep the edited embroidery pattern from exceeding the range within which the user's sewing machine 3 can performing the sewing. Furthermore, even in a case where the user's sewing machine 3 is compatible with a plurality of the frame sizes (C), it is possible for the user to visually recognize only the frame size that the user has selected.

The present disclosure is not limited to the embodiments that are described above, and it is obvious that various types of modifications can be made within the scope of the present invention. For example, the embroidery data providing program may also be stored in the sewing machine 3, and the embroidery data may also be generated and stored in the sewing machine 3 in the same manner as the embroidery data are generated and stored in the PC 9 in the second embodiment.

Furthermore, in the first embodiment, the authentication information for the user is acquired in the login processing at Step S3, but the present invention is not limited to this example. For example, on a user information update screen that is not shown in the drawings, the user of the PC 1 may input a product number for a new sewing machine 3, in addition to the user authentication information. In the server 5, in the login processing at Step S3, the authentication information and the product number that have been input on the user information update screen may be acquired along with a user information update request. The user information database 200 may then be referenced, and the product number in the user information that includes the authentication information may then be updated to the product number that has been newly input from the PC 1. This makes it possible for the server 5 to adapt easily and quickly, even in a case where the user of the PC 1 has purchased a new sewing machine 3 or a software upgrade has been implemented.

In addition, in both the first and the second embodiments, the determination is made as to whether the embroidery pattern that has been edited on the edit screen will fit into the sewing area frame, but the object of the determination is not limited to this example. For example, in a case where the user has freely selected the embroidery pattern without using the edit screen, a determination may also be made as to whether the selected embroidery pattern will fit into the embroiderable frame size. Then in a case where the embroidery pattern that the user has selected will not fit into the embroiderable frame size, the transmission and the generation of the embroidery data may be restricted.

Furthermore, in both the first and the second embodiments, in a case where the embroidery pattern will not fit into the sewing area frame, the transmission and the generation of the embroidery data are restricted, but the restriction condition is not limited to this example. Any other restriction condition may be employed as it is a standard for determining whether the embroidery pattern will fit within a range within which the sewing machine 3 is capable of sewing. For example, sewing machine performance information that indicates the performance of the sewing machine 3 may also be included in the machine information that is registered in the machine information database 300. Examples of the sewing machine performance information may include a maximum data volume for the embroidery data that can be handled by the sewing machine 3 (for example, the memory capacity of the sewing machine 3), a maximum number of stitches that can be sewn by the sewing machine 3, a maximum number of thread changes that the sewing machine 3 can perform and the like. In this case, a determination may be made as to whether the embroidery data and the embroidery pattern are compatible with the sewing machine performance information, instead of the determinations at Step S23 (FIG. 7) and Step S119 (FIG. 16), or in conjunction with the determinations at Step S23 and Step S119. In concrete terms, in a case where it is determined at Step S23 that the embroidery data that were generated at Step S19 exceed the maximum data volume for the embroidery data that can be handled by the sewing machine 3, the downloading of the embroidery data may be restricted, and error information may be transmitted (Step S27). Moreover, in a case where it is determined at Step S119 that the number of stitches in the edited embroidery pattern exceeds the maximum number of stitches that can be sewn by the sewing machine 3, the generating of the embroidery data may be restricted, and error information may be displayed (Step S121).

Further, in the first embodiment, the transmission of the embroidery data is restricted at Step S27 (FIG. 7), but the generating of the embroidery data may be restricted instead of the transmission. In that case, the generating and the storing of the embroidery data (Step S19) may be performed in a case where the embroidery pattern will fit into the sewing area frame (YES at Step S23).

Also in the first embodiment, the processing that determines whether the embroidery pattern will fit within the range within which the sewing machine 3 is capable of sewing and the processing that restricts the transmission and the generating of the embroidery data are both performed in the server 5. However, these sorts of determination processing and restriction processing may also respectively be performed by different units. For example, the determination processing may be performed in the server 5, and the restriction processing may be performed in the PC 1. In that case, the server 5 may transmit the result of determination processing (for example, whether the embroidery pattern will fit into the embroiderable frame size) to the PC 1, and the PC 1 may perform the restriction processing in keeping with the result of determination processing. The restriction processing may also be performed in the server 5, and the determination processing may also be performed in the PC 1. In that case, the PC 1 may transmit the result of the determination processing to the server 5, and the PC 1 may control the restriction processing in the server 5 in keeping with the result of determination processing. Both the determination processing and the restriction processing may also be performed in the PC 1. In that case, the server 5 may transmit to the PC 1 the data that are necessary for the determination processing (for example, the embroiderable frame size and the like), and the PC 1 may perform the determination processing and the restriction processing based on the data.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data providing apparatus, comprising:

a model information acquisition device that acquires, from an identification information storage device storing identification information and model information in association with one another, the model information that corresponds to the identification information input by an input device for inputting information, or acquires the model information input by the input device, the identification information being unique to a user or to a sewing machine, and the model information indicating a model of the sewing machine;

a size storage device that stores the model information and at least one embroiderable size in association with one another, the at least one embroiderable size indicating a size of an embroidery pattern that can be sewn by the model of the sewing machine indicated by the model information;

a size acquisition device that, from the size storage device, acquires the at least one embroiderable size that corresponds to the model information acquired by the model information acquisition device;

a pattern information acquisition device that acquires target pattern information, the target pattern information being information relating to a target pattern, the target pattern being an embroidery pattern to be embroidered by the model of the sewing machine indicated by the model information acquired by the model information acquisition device;

an embroidery data output device that outputs as output data, to a storage device that is capable of storing information, at least one of embroidery data of the target pattern to be used by the model of the sewing machine indicated by the model information and data for generating the embroidery data of the target pattern;

a size determination device that, based on the target pattern information acquired by the pattern information acquisition device, determines whether the target pattern will fit within the at least one embroiderable size acquired by the size acquisition device; and a restriction device that, in a case where it is determined by the size determination device that the target pattern will not fit within the at least one embroiderable size, restricts at least one of outputting of the output data by the embroidery data output device and pre-output processing relating to the embroidery data of the target pattern.

2. The embroidery data providing apparatus according to claim 1, further comprising:

a screen output device that outputs, to a display device that is capable of displaying information, an edit screen for at least one of creating and editing the target pattern in a state in which the at least one embroiderable size acquired by the size acquisition device is graphically shown.

3. The embroidery data providing apparatus according to claim 1, further comprising:

a size information output device that outputs, to a display device that is capable of displaying information, at least one size information item that indicates the at least one embroiderable size acquired by the size acquisition device.

4. The embroidery data providing apparatus according to claim 3, wherein:

the size information output device, in a case where a plurality of the at least one embroiderable size exists, outputs a plurality of the at least one size information item in list form to the display device.

5. The embroidery data providing apparatus according to claim 4, further comprising:

a screen output device that outputs, to the display device, an edit screen for at least one of creating and editing the target pattern in a state in which the at least one embroiderable size that corresponds to a size information item that has been selected from among the plurality of size information items output in list form is graphically shown.

6. The embroidery data providing apparatus according to claim 1, wherein:

the identification information storage device includes:

a user information storage device that stores user identification information and machine identification information in association with one another, the user information being unique to the user, and the machine identification information being unique to the sewing machine; and a machine information storage device that stores the machine identification information and the model information in association with one another, and the model information acquisition device includes:

a user information acquisition device that acquires, from the user information storage device, the machine identification information that corresponds to the user identification information input by the input device; and a machine information acquisition device that acquires, from the machine information storage device, the model information that corresponds to the machine identification information acquired by the user information acquisition device.

7. The embroidery data providing apparatus according to claim 6, wherein:

the model information acquisition device is capable of acquiring, in addition to the user identification information, the machine identification information and a change request, and the embroidery data providing apparatus further comprises:

an identification information update device that, in a case where the change request is acquired by the model information acquisition device, updates the machine identification information stored in the user information storage device in association with the user identification information to the machine identification information acquired by the model information acquisition device.

8. A computer-readable medium storing an embroidery data providing program, the embroidery data providing program comprising instructions that cause a computer to perform the steps of:

acquiring, from an identification information storage device storing identification information and model information in association with one another, the model information that corresponds to the identification information input by an input device for inputting information, or the model information input by the input device, the identification information being unique to a user or to a sewing machine, and the model information indicating a model of the sewing machine;

acquiring, from a size storage device that stores the model information and at least one embroiderable size in association with one another, the at least one embroiderable size that corresponds to the model information that has been acquired, the at least one embroiderable size indicating a size of an embroidery pattern that can be sewn by the model of the sewing machine indicated by the model information;

acquiring target pattern information, the target pattern information being information relating to a target pattern, the target pattern being an embroidery pattern to be embroidered by the model of the sewing machine indicated by the model information that has been acquired;

outputting as output data, to a storage device that is capable of storing information, at least one of embroidery data of the target pattern to be used by the model of the sewing machine indicated by the model information and data for generating the embroidery data of the target pattern;

determining, based on the target pattern information that has been acquired, whether the target pattern will fit within the at least one embroiderable size that has been acquired; and restricting, in a case where it is determined that the target pattern will not fit within the at least one embroiderable size, at least one of outputting of the output data and pre-output processing relating to the embroidery data of the target pattern.

9. The computer-readable medium according to claim 8, wherein the embroidery data providing program further comprises instructions that cause the computer to perform the step of:

outputting, to a display device that is capable of displaying information, an edit screen for at least one of creating and editing the target pattern in a state in which the at least one embroiderable size that has been acquired is graphically shown.

10. The computer-readable medium according to claim 8, wherein the embroidery data providing program further comprises instructions that cause the computer to perform the step of:

outputting, to a display device that is capable of displaying information, at least one size information item that indicates the at least one embroiderable size that has been acquired.

11. The computer-readable medium according to claim 10, wherein:

a plurality of the at least one size information item is output in list form to the display device in a case where a plurality of the at least one embroiderable size exists.

12. The computer-readable medium according to claim 11, wherein the embroidery data providing program further comprises instructions that cause the computer to perform the step of:

outputting, to the display device, an edit screen for at least one of creating and editing the target pattern in a state in which the at least one embroiderable size that corresponds to a size information item that has been selected from among the plurality of size information items output in list form is graphically shown.

13. The computer-readable medium according to claim 8, wherein:

the identification information storage device includes:

a user information storage device that stores user identification information and machine identification information in association with one another, the user information being unique to the user, and the machine identification information being unique to the sewing machine; and a machine information storage device that stores the machine identification information and the model information in association with one another, and the step of acquiring the model information from the identification information storage device includes the steps of:

acquiring, from the user information storage device, the machine identification information that corresponds to the user identification information input by the input device; and acquiring, from the machine information storage device, the model information that corresponds to the machine identification information that has been acquired.

14. The computer-readable medium according to claim 13, wherein:

the machine identification information and a change request can be acquired in addition to the user identification information in the step of acquiring the model information from the identification information storage device, and the embroidery data providing program further comprises instructions that cause the computer to perform the step of:

updating the machine identification information stored in the user information storage device in association with the user identification information to the machine identification information that has been acquired, in a case where the change request has been acquired.

15. An embroidery data providing system that includes a terminal apparatus and a server that are connected to one another through a network, wherein:

the terminal apparatus includes:

an information transmission device that transmits, to the server, at least one of identification information and model information that have been input to the terminal apparatus, the identification information being unique to a user or to a sewing machine, and the model information indicating a model of the sewing machine;

a screen display device that displays an edit screen for at least one of creating and editing an embroidery pattern, based on information for generating the edit screen that has been received from the server;

a target pattern transmission device that transmits target pattern information to the server, the target pattern information being information relating to a target pattern, the target pattern being an embroidery pattern that has been at least one of created and edited on the edit screen; and an embroidery data storage device that stores embroidery data of the target pattern that have been received from the server and will be used for embroidery sewing by the sewing machine, and the server includes:

a model information acquisition device that acquires, from an identification information storage device storing the identification information and the model information in association with one another, the model information that corresponds to the identification information received from the terminal apparatus, or acquires the model information received from the terminal apparatus;

a size storage device that stores the model information and at least one embroiderable size in association with one another, the at least one embroiderable size indicating a size of an embroidery pattern that can be sewn by the model of the sewing machine indicated by the model information;

a size acquisition device that, from the size storage device, acquires the at least one embroiderable size that corresponds to the model information acquired by the model information acquisition device;

a screen information transmission device that transmits, to the terminal apparatus, the information for generating the edit screen in a state in which the at least one embroiderable size that has been acquired by the size acquisition device is graphically shown;

an embroidery data generation device that generates the embroidery data of the target pattern based on the target pattern information received from the terminal apparatus;

an embroidery data transmission device that transmits, to the terminal apparatus, the embroidery data of the target pattern generated by the embroidery data generation device;

a size determination device that, based on the target pattern information received from the terminal apparatus, determines whether the target pattern will fit within the at least one embroiderable size that has been acquired by the size acquisition device; and a restriction device that, in a case where it is determined by the size determination device that the target pattern will not fit within the at least one embroiderable size, restricts at least one of generating of the embroidery data of the target pattern by the embroidery data generation device and transmitting of the embroidery data by the embroidery data transmission device.

16. An embroidery data providing apparatus, comprising:

a model information acquisition device that acquires, from an identification information storage device storing identification information and model information in association with one another, the model information that corresponds to the identification information input by an input device for inputting information, or acquires the model information input by the input device, the identification information being unique to a user or to a sewing machine, and the model information indicating a model of the sewing machine;

a range storage device that stores the model information and a sewable range in association with one another, the sewable range being a range within which the model of the sewing machine indicated by the model information is capable of sewing;

a range acquisition device that acquires, from the range storage device, the sewable range that corresponds to the model information acquired by the model information acquisition device;

a pattern information acquisition device that acquires target pattern information, the target pattern information being information relating to a target pattern, the target pattern being an embroidery pattern to be embroidered by the model of the sewing machine indicated by the model information acquired by the model information acquisition device;

an embroidery data output device that outputs as output data, to a storage device that is capable of storing information, at least one of embroidery data of the target pattern to be used by the model of the sewing machine indicated by the model information and data for generating the embroidery data of the target pattern;

a range determination device that, based on the target pattern information acquired by the pattern information acquisition device, determines whether the target pattern will fit within the sewable range acquired by the range acquisition device; and a restriction device that, in a case where it is determined by the range determination device that the target pattern will not fit within the sewable range, restricts at least one of outputting of the output data by the embroidery data output device and pre-output processing relating to the embroidery data of the target pattern.

* * * * *